US009791221B1

(12) United States Patent
Litch

(10) Patent No.: US 9,791,221 B1
(45) Date of Patent: Oct. 17, 2017

(54) CONDENSER ASSEMBLY SYSTEM FOR AN APPLIANCE

(71) Applicant: Whirlpool Corporation, Benton Harbor, MI (US)

(72) Inventor: Andrew David Litch, Saint Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 553 days.

(21) Appl. No.: 13/663,623

(22) Filed: Oct. 30, 2012

(51) Int. Cl.

| | |
|---|---|
| ***F28F 9/26*** | (2006.01) |
| ***F28D 1/053*** | (2006.01) |
| ***F25B 39/04*** | (2006.01) |
| ***F28D 1/047*** | (2006.01) |
| ***F28F 1/12*** | (2006.01) |

(52) U.S. Cl.
CPC ..... *F28F 9/262* (2013.01); *F25B 39/04* (2013.01); *F28D 1/0477* (2013.01); *F28D 1/05391* (2013.01); *F28F 1/122* (2013.01)

(58) Field of Classification Search
CPC ..... F28F 9/262; F28F 1/22; F28D 1/05391; F28D 1/0477; F25B 39/04
USPC ..... 165/144, 145
See application file for complete search history.

(56) References Cited

U.S. PATENT DOCUMENTS

| | | | | |
|---|---|---|---|---|
| 2,515,972 | A * | 7/1950 | White et al. | 62/516 |
| 4,490,991 | A | 1/1985 | Griffin | |
| 5,070,708 | A * | 12/1991 | Malosh et al. | 62/295 |
| 5,428,973 | A * | 7/1995 | Temmyo et al. | 62/452 |
| 5,502,983 | A * | 4/1996 | Dasher | 62/454 |
| 5,592,829 | A * | 1/1997 | Kim | 62/428 |
| 5,806,585 | A * | 9/1998 | Yoshida et al. | 165/171 |
| 5,881,567 | A | 3/1999 | Junge et al. | |
| 6,253,839 | B1 * | 7/2001 | Reagen et al. | 165/151 |
| 6,389,695 | B1 * | 5/2002 | Dall'Oro et al. | 29/890.03 |
| 6,640,885 | B2 * | 11/2003 | Jenkins, Jr. | 165/171 |
| 6,715,539 | B2 * | 4/2004 | Bianco | 165/122 |
| 6,793,010 | B1 * | 9/2004 | Manole | 165/122 |
| 7,908,883 | B2 * | 3/2011 | Wu et al. | 62/441 |
| 2005/0044882 | A1 * | 3/2005 | Hong et al. | 62/507 |
| 2005/0061021 | A1 * | 3/2005 | Uihlein et al. | 62/441 |
| 2005/0061926 | A1 * | 3/2005 | Pereira et al. | 248/71 |
| 2008/0142197 | A1 * | 6/2008 | Van Andel et al. | 165/104.26 |

(Continued)

FOREIGN PATENT DOCUMENTS

| | | | |
|---|---|---|---|
| GB | 184222 | A | 8/1922 |
| GB | 555881 | A | 9/1943 |

OTHER PUBLICATIONS

Whirlpool Corp. Part No. W10276898 "Condenser—Formed, FD", May 13, 2009.

*Primary Examiner* — Justin Jonaitis
*Assistant Examiner* — Joel Attey
(74) *Attorney, Agent, or Firm* — Price Heneveld LLP

(57) ABSTRACT

An appliance includes a compact condenser assembly formed with at least two separately and independently produced wire on tube condensers. Each of the at least two wire on tube condensers has a condenser inlet and a condenser outlet. The at least two wire on tube condensers are at least substantially locked and positioned in a matingly engaged configuration forming a compact condenser assembly. The at least two wire on tube condensers are configured to be operationally connected in at least one of a parallel configuration, a series configuration, a selectable configuration, and a bypass configuration.

19 Claims, 23 Drawing Sheets

(56) References Cited

U.S. PATENT DOCUMENTS

| | | | | |
|---|---|---|---|---|
| 2008/0164016 | A1* | 7/2008 | Lee et al. | 165/178 |
| 2009/0296346 | A1* | 12/2009 | Van Andel | 361/696 |
| 2010/0089560 | A1 | 4/2010 | Shikazono et al. | |
| 2010/0122805 | A1 | 5/2010 | Yang | |
| 2010/0326639 | A1* | 12/2010 | Ando | F28D 1/0472 165/144 |
| 2012/0060545 | A1* | 3/2012 | Rafalovich et al. | 62/455 |

* cited by examiner

CONDENSER ASSEMBLY SYSTEM FOR AN APPLIANCE

STATEMENT REGARDING FEDERALLY SPONSORED RESEARCH AND DEVELOPMENT

This invention was made with government support under Award No. DE-EE0003910, awarded by the U.S. Department of Energy. The government has certain rights in the invention.

FIELD OF THE INVENTION

The present invention generally relates to a condenser assembly and, more specifically, to a compact wire on tube condenser assembly for a refrigerating appliance.

BACKGROUND OF THE INVENTION

Known condensers are formed from a tubular conduit constructed into a serpentine shape with a wire frame attached around the tubular conduit. This type of condenser is often referred to as a wire on tube condenser, a wire and tube condenser, or a WoT condenser. These wire on tube condensers may have a planar lateral profile, a U-shaped lateral profile, a sawtooth lateral profile, or other profiles. A condenser with a lateral profile of a sawtooth are sometimes referred to as a sawtooth condenser, a zig-zag condenser, a wave condenser, or the like.

Currently, in order to increase the amount of heat exchanged from a wire on tube condenser via the method of increasing heat transfer surface area, the heat exchange surface area of at least one of the wires and of the tubular conduit may be increased. In order to increase the length of tubular conduit and retain the current bend radius of the tubular conduit, the overall dimensions of the condenser may increase. The increase in overall volume of the condenser with an increased heat exchange surface area may be unacceptable since the condenser may have to fit into an existing air passageway.

A modified manufacturing process or custom tooling may be needed in order to reduce the bend radius of the tubular conduit and form a condenser with a tighter wound tubular conduit. Using a custom manufacturing process to minimize the increase in dimensions of the condenser is typically not desired due to additional manufacturing or tooling costs.

SUMMARY OF THE INVENTION

One aspect of the present invention relates to a wire on tube condenser assembly that includes at least two separately and independently produced wire on tube condensers where each of the at least two wire on tube condensers has a condenser inlet and a condenser outlet. The at least two wire on tube condensers are at least substantially locked and positioned in a matingly engaged configuration forming a condenser assembly. The at least two wire on tube condensers are configured to be operationally connected in at least one of a parallel configuration, a series configuration, a selectable configuration, a split configuration, and a bypass configuration.

Another aspect of the present invention includes an appliance having a machine compartment that includes a housing with at least one airflow path and a fan configured to cause a flow of cooling air. An air passageway is operationally connected to the machine compartment and configured to allow airflow into the machine compartment. The air passageway contains a condenser assembly that includes at least two separately and independently produced wire on tube condensers that are at least substantially locked and positioned in a matingly engaged configuration and operationally connected in at least one of the following configurations: a parallel configuration, a series configuration, a selectable configuration, a split configuration, and a bypass configuration. The air passageway further contains an exhaust port for discharging heated air radiated from the at least two wire on tube condensers. Each of the at least two wire on tube condensers has a condenser inlet and a condenser outlet.

Yet another aspect of the present invention includes a method of assembling a compact wire on tube condenser assembly that includes the steps of providing at least two separately and independently produced wire on tube condensers, at least substantially locking the at least two condensers within an air passageway of an appliance in a matingly engaged configuration to form the condenser assembly that is typically configured to be used and entirely spaced within the air passageway.

These and other features, advantages and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiments which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

Figure 1:
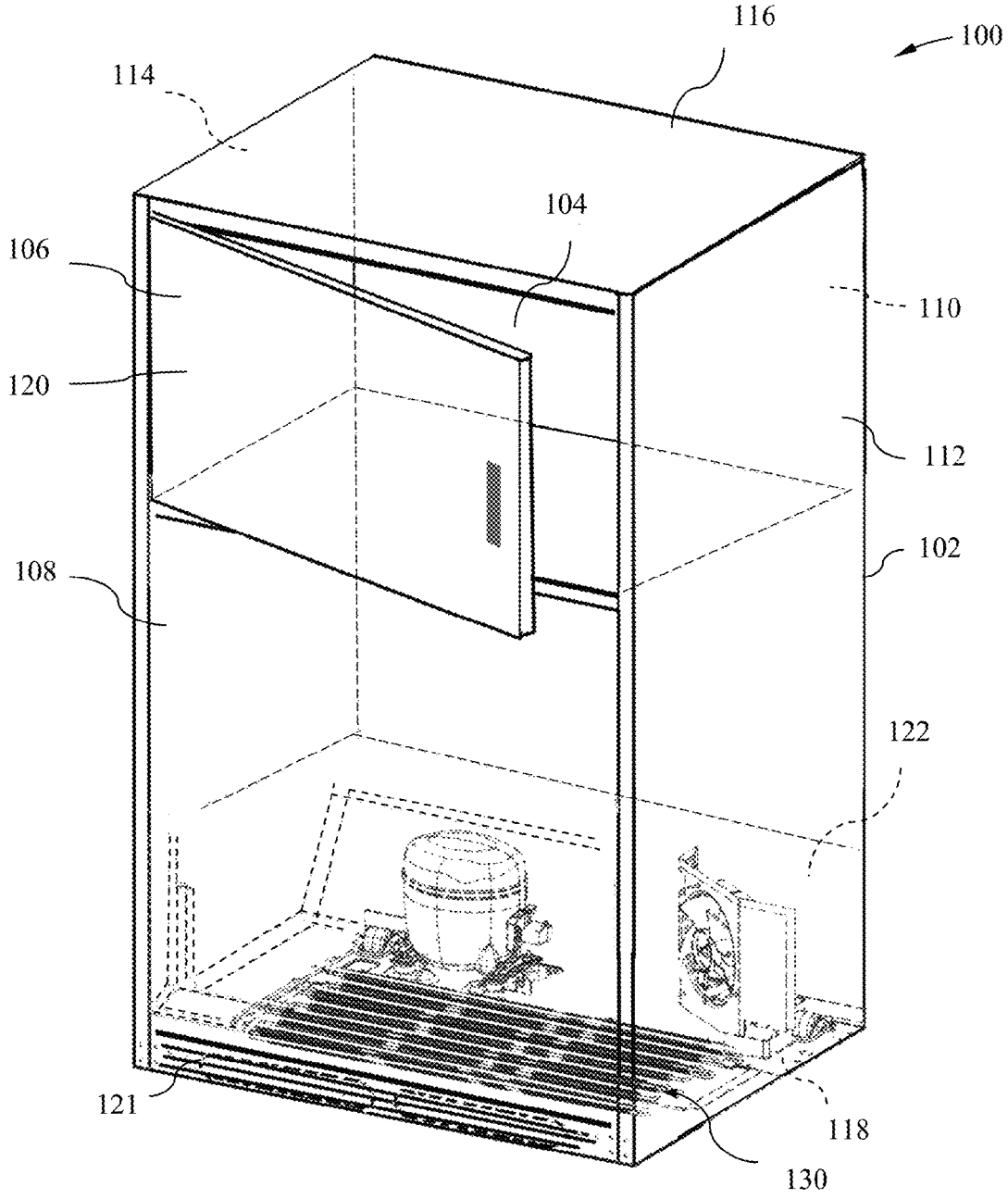
FIG. 1 is a front, upper left perspective view of an appliance incorporating an embodiment of the condenser assembly of the present invention.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present disclosure includes an appliance with a heating, cooling, dehumidifying, or refrigerating function having a heat exchange system, alternately referred to as a vapor compression system. Vapor compression systems of the present disclosure typically include at least one evaporator, at least one compressor, at least one expansion device, and a condenser assembly. The appliance may be any appliance incorporating a vapor compression system, including, but not limited to, a refrigerator, a freezer, a dishwasher, a laundry dryer, a combination laundry washer dryer, an air conditioner, an air heater, a water heater, a dehumidifier, and the like.

An evaporator of the present application is a heat exchanger where heat is absorbed into a working refrigerant within the evaporator and the working refrigerant is evaporated. A condenser is a heat exchanger where heat is rejected from the working refrigerant and the refrigerant is then condensed. The condenser assembly of the present application may be used as an evaporator assembly. The condenser assembly may function as an evaporator or a heat exchanger if configured as such in a vapor compression system and such systems are meant to be encompassed by the present application. The words "tube", "tubing", and the phrase "tubular conduit" are used interchangeably and refer to conduit configured to contain and capable of containing and communication of one or more refrigerants, typically fluid refrigerants through the conduit.

The inventions disclosed herein provide a method to assemble a compact condenser assembly while minimizing the increase in overall dimensions, or volume, of the condenser assembly and significantly and dramatically minimizing or eliminating the need for a custom manufacturing process or custom tooling all while also doing so in a manner that surprisingly also minimizes the decrease in airflow due to the increased heat exchange surface area.

Additionally, the condenser assembly includes at least two condenser inlets and at least two condenser outlets. The condenser assembly is operationally configured so that at least two portions of the condenser assembly tubular conduit may be operationally connected and provide a flow of refrigerant(s) or other fluids through the portions of the tubular conduit operationally connected in one or more of the following configurations: in parallel, in series, and/or selectively connected. Selectively connected (i.e. a selectable configuration) is defined as a configuration which allows the user and/or the appliance to selectively operate the sub-condensers in at least one of a parallel configuration, a series configuration, a bypassed configuration where at least one of the sub-condensers is bypassed, and/or a split configuration where at least one of the sub-condensers is operationally connected to a second separate heat exchange system from a first heat exchange system, typically based upon operational needs of the appliance. The appliance or the condenser assembly typically may have at least one or more valve and/or connector that are configured to change the connection between the individual condensers from a parallel configuration to a series configuration (and vice versa).

Alternatively, a portion of the condenser assembly tubular conduit may be operationally connected to a separate heat exchange system, may be selectively bypassed, connected or selectively connected to a heat storage or a heat recovery system, and/or selectively connected to more than one heat exchange circuit.

The direction of flow in a portion of the condenser assembly tubular conduit may be operationally controlled to be in the same direction or in an opposite direction than the flow in a second portion of the condenser assembly tubular conduit. The condenser assembly typically includes at least two separately and independently produced wire on tube condensers. The at least two wire on tube condensers are at least substantially locked or fully locked and positioned in a matingly engaged configuration. The at least two wire on tube condensers may be stacked, layered, spaced apart, or nested together to form a condenser assembly with two condenser inlets and two condenser outlets. When the condenser assembly includes two or more serpentine condensers in a zig-zag or sawtooth configuration, the valleys of the condensers are seated and nested within one another and the bottom facing surface of the upper condenser typically, but does not necessarily, directly engages the upper surface of the condenser below it. Multiple condensers may be stacked to form a condenser assembly. Two, three, four, or a plurality of condensers may be stacked or assembled into a multilayer condenser assembly.

The stacking of the condensers offsets the tubular conduits to expose the tubular conduits to airflow. The spacing of the tubular conduits and wires minimizes the obstruction of airflow. The wires and/or the tubular conduit of the additional condenser may rest on top of, be spaced above, be spaced apart, and/or fit in the spaces between the wires and tubular conduit of the first condenser. Spacers may be used to position the at least two condensers with respect to each other. The spacers provide/produce a gap between the tubular conduits of each condenser. The spacers may be used to fasten the at least two condensers to each other, to accommodate dimensional differences between the condenser profiles, to improve airflow through the condensers, and/or to prevent movement between the at least two condensers. The spacers may alternatively be one or more of a spacer, a clip, a bracket, a brace, a clamp, a holder, a pad, an insert, a fastener, a screw, a shim, and/or a sheet of metal or plastic or any combination thereof. The spacers may alternatively fasten a first condenser to a surface in an air passageway and fasten a second condenser to a second surface in the air passageway such that the first and second condensers are spaced with a gap between the condensers.

There may be sufficient elasticity in the wire and tube condensers depending upon various factors of their construction to allow layering of at least two condensers to form a condenser assembly without using any spacers. The at least two condensers will typically have a substantially similar or identical lateral profile and may snugly fit together enough to prevent shifting, rubbing, or vibration without the need for any spacers between the two condensers of the condenser assembly.

Optionally, at least one fastener may be used to fasten the condenser assembly to a surface of an air passageway of the appliance or another portion of the appliance. Optionally, at least one fastener may be used to fasten the at least two condensers together to form a condenser assembly.

At least one of a valve and a connector may be assembled as part of or operably engaged with a condenser assembly of the present application. The condenser assembly may have only a single inlet and a single outlet since the connectors to the additional inlet and the additional outlet may be operably engaged in the condenser assembly. Conversely, at least one of a valve and a connector may be alternatively separate from the condenser assembly and assembled as part of the appliance instead.

The condenser assemblies, because they typically include two or more individual condensers that themselves can function as a single condenser, allow for a modular approach and permit the condenser assemblies to be used in multiple applications where more or less surface area of the condenser is needed or would be advantageous. A multiple layer condenser assembly may be used to reduce the space needed for the air passageway if an increase in overall heat exchange surface area is not needed.

FIG. 1 shows an appliance 100 having an appliance exterior 102, an appliance interior volume 104 defined by the appliance exterior 102, and an appliance access 106, which is typically either a drawer such as a pantry slide out drawer (not shown) or one or more hingedly engaged doors that, when opened, allow access to the interior volume 104 of the appliance 100. The appliance exterior 102 has an appliance front 108, an appliance back 110, an appliance first (right) side 112, an appliance second (left) side 114, an appliance top 116, and an appliance bottom 118. The appliance access 106, as mentioned above, may be a drawer (not shown) or a door 120, but could be any structure that permits user access to the interior volume 104 of the appliance 100 or an opening (not shown) in the appliance exterior 102. The appliance exterior 102 may have at least one airflow inlet 121.

Figure 2:
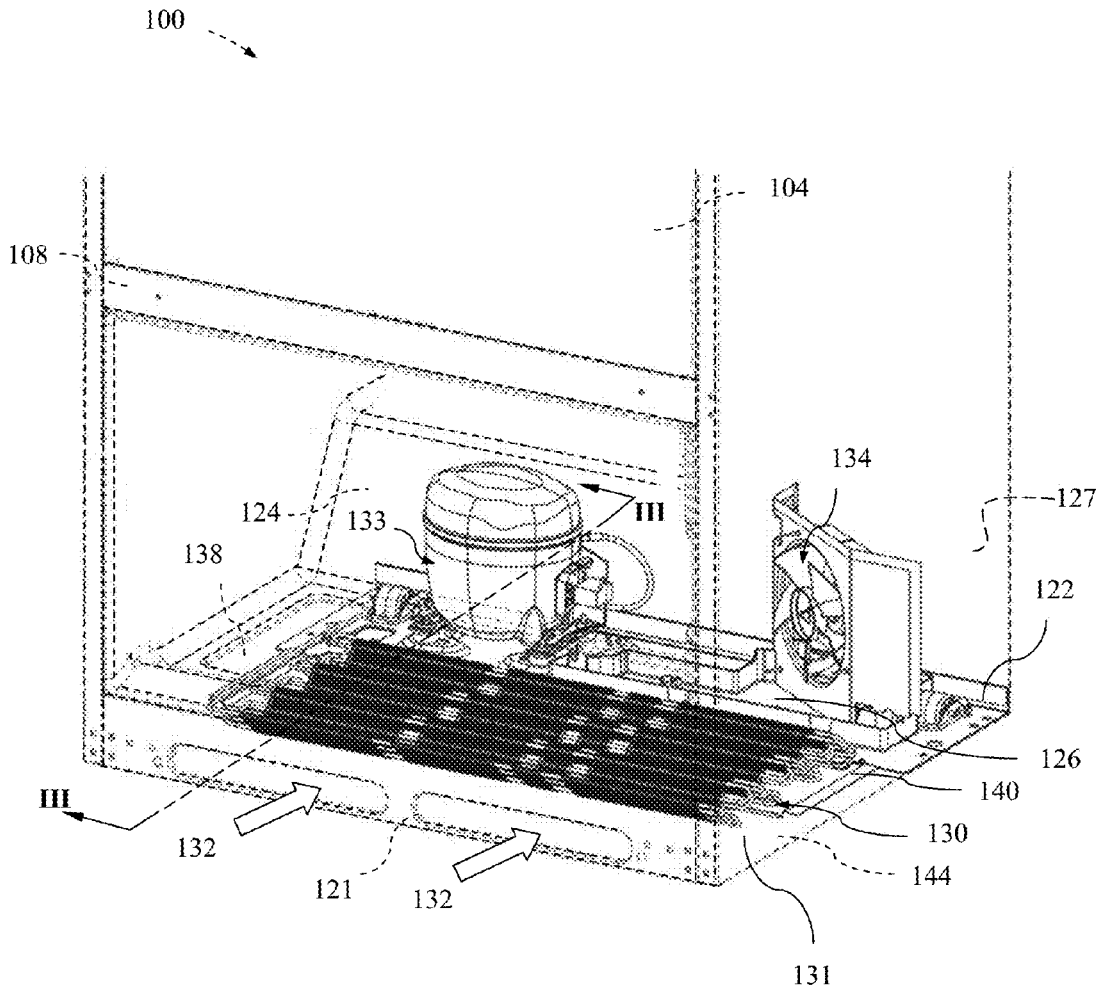
FIG. 2 is an interior front perspective view of the machine compartment portion of the appliance of FIG. 1 incorporating an aspect of the condenser assembly of the present invention.

Referring to FIG. 1 and FIG. 2, the appliance 100 typically has a machine compartment 122 typically located at least partially inside the appliance 100. The machine compartment 122 may have a machine compartment housing 124 with at least one machine compartment opening 126 to the interior volume of the machine compartment 122. A portion of the machine compartment 122 may be unenclosed 127 by a machine compartment housing 124 of the appliance 100. The machine compartment housing 124 may optionally include one or more: vents, slots, holes, louvers, or the like (not shown) in order to facilitate airflow from the machine compartment 122 and exhaust air that has contacted the condenser assembly 130 and/or components within the machine compartment 122. The machine compartment 122 may include an air passageway 131 (FIGS. 2-3) or may be operationally connected with the at least one machine compartment opening 126 to the air passageway 131. The air passageway 131 may be operationally connected to at least one airflow inlet 121 to allow airflow 132 into the air passageway 131. A condenser assembly 130 may be positioned in the air passageway 131. At least a compressor 133 and optionally a fan 134 are typically spaced or positioned within the machine compartment 122.

Figure 3:
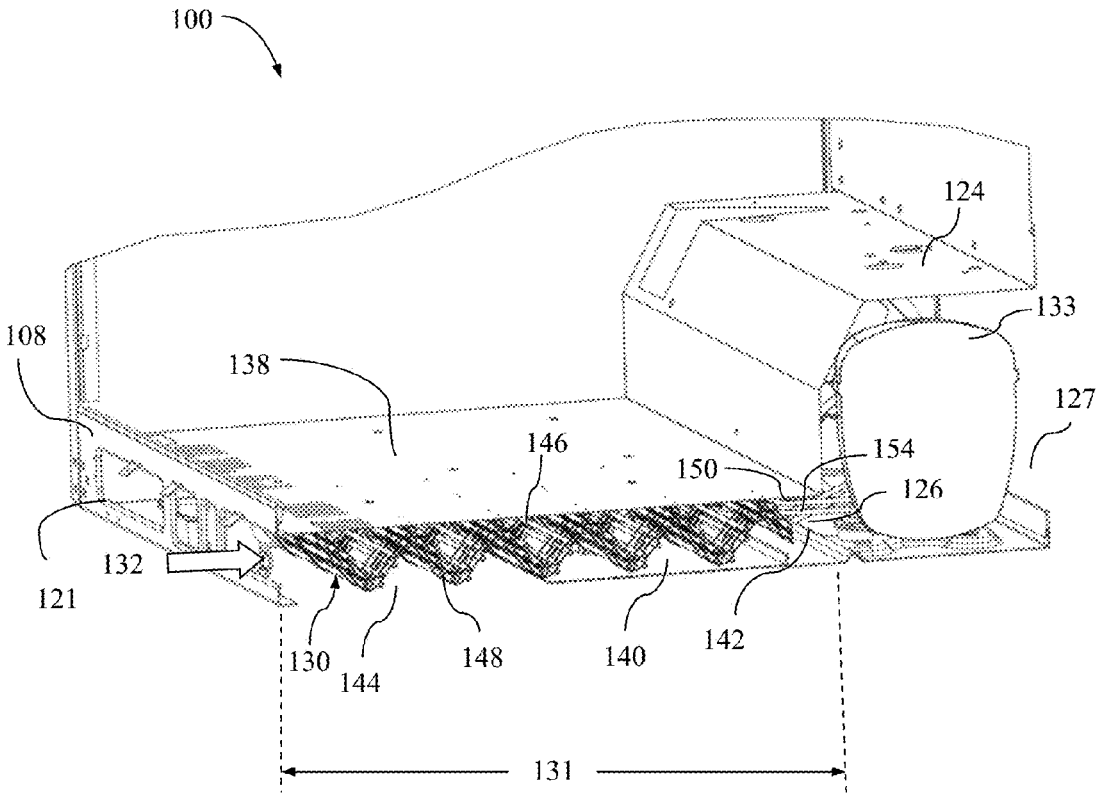
FIG. 3 shows a cross-sectional perspective view of the portion of the appliance of FIG. 2 taken along line III-III in FIG. 2 according to an aspect of the condenser assembly of the present invention.
Figure 4:
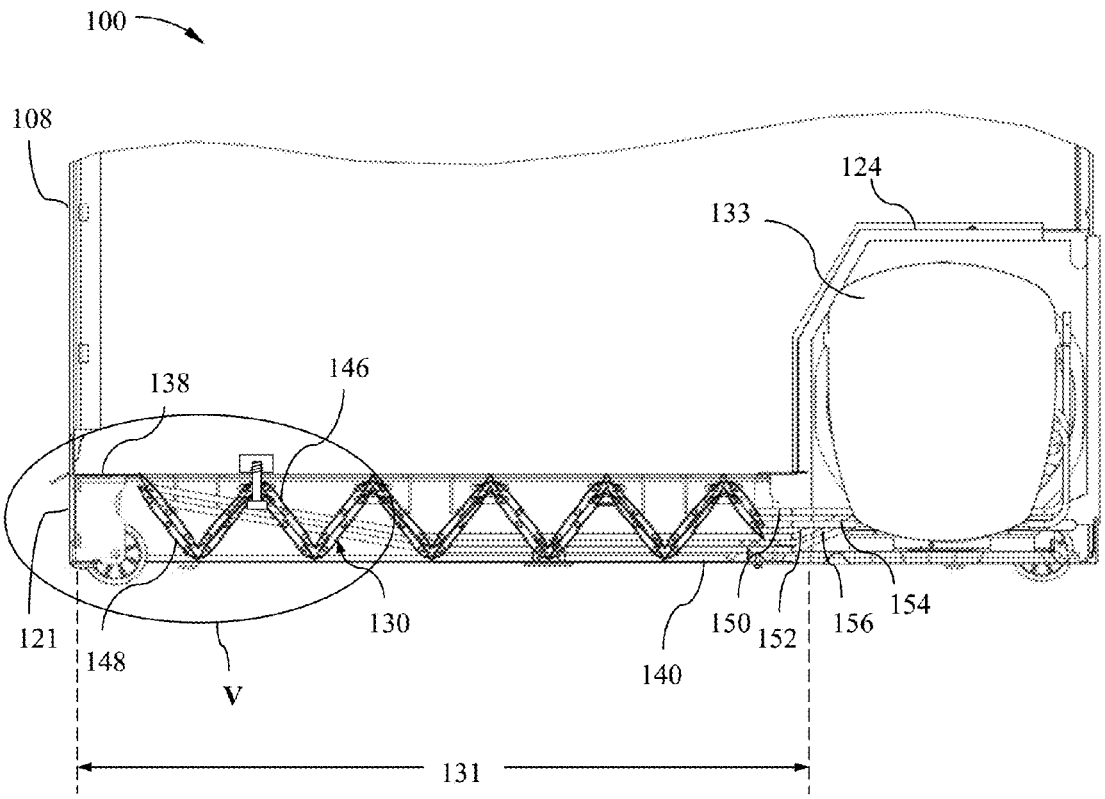
FIG. 4 shows an elevated cross-section of the portion of the appliance of FIG. 2 taken along line III-III in FIG. 2 according to an aspect of the condenser assembly of the present invention.
Figure 5:
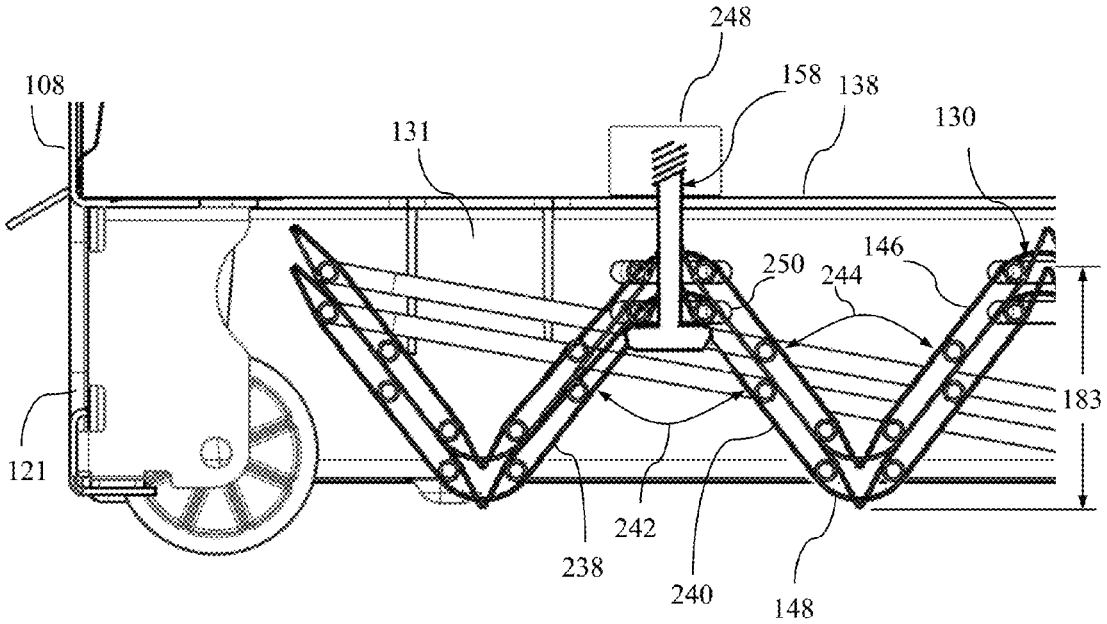
FIG. 5 shows an enlarged, elevated cross-section of the portion of the appliance shown in the circled portion V of FIG. 4.

Referring to FIG. 3 and FIG. 4, the air passageway 131 typically includes a condenser assembly 130, at least one airflow inlet 121 that permits ambient air or air from outside the air passageway ingress to the air passageway, an air passageway upper surface 138, an air passageway lower surface 140, and an airflow outlet 142 that permits air egress of air from within the air passageway 131. The air passageway 131 may include unenclosed portions 144, which are not enclosed within a housing on one or more sides or enclosed within the appliance walls on one or more sides. The vertical distance between the passageway upper surface 138 and the passageway lower surface 140 is typically from about 20 mm to about 200 mm, more typically between about 100 mm and about 40 mm, and preferably about 66 mm. The condenser assembly 130 (FIG. 4) typically includes at least a first condenser 146, a second condenser 148, a first condenser inlet 150, a first condenser outlet 152, a second condenser inlet 154, and a second condenser outlet 156. FIG. 5 depicts a cross-sectional view of a portion of the air passageway 131 and a portion of the condenser assembly 130 according to one aspect of the present invention. The condenser assembly 130 typically includes at least a first condenser 146 and a second condenser 148 in two layers, but additional condenser layers may also be employed. The condenser assembly 130 may optionally be fastened to one or more surface(s) 138 by a fastener 158. Typically, the surface 138 is a portion of either or both of the air passageway 131 floor or wall, the ceiling wall or a side wall or a floor of the machine compartment 122. Most typically, the condenser assembly is fastened to the ceiling wall when it is attached to a surface within the machine compartment 122. The first condenser 146 and the second condenser 148 are typically at least substantially locked or fully locked together in a frictional manner with one another such that the first condenser 146 and the second condenser 148 do not move and rub against one another during operation. The condensers 146, 148 used are typically positioned in a mating engaged configuration forming a condenser assembly 130. As discussed previously, the condenser assembly 130 is typically formed from a plurality of condensers 146, 148 without the use of any spacers between the first condenser 146 and the second condenser 148, but spacers may optionally be employed.

Figure 6A:
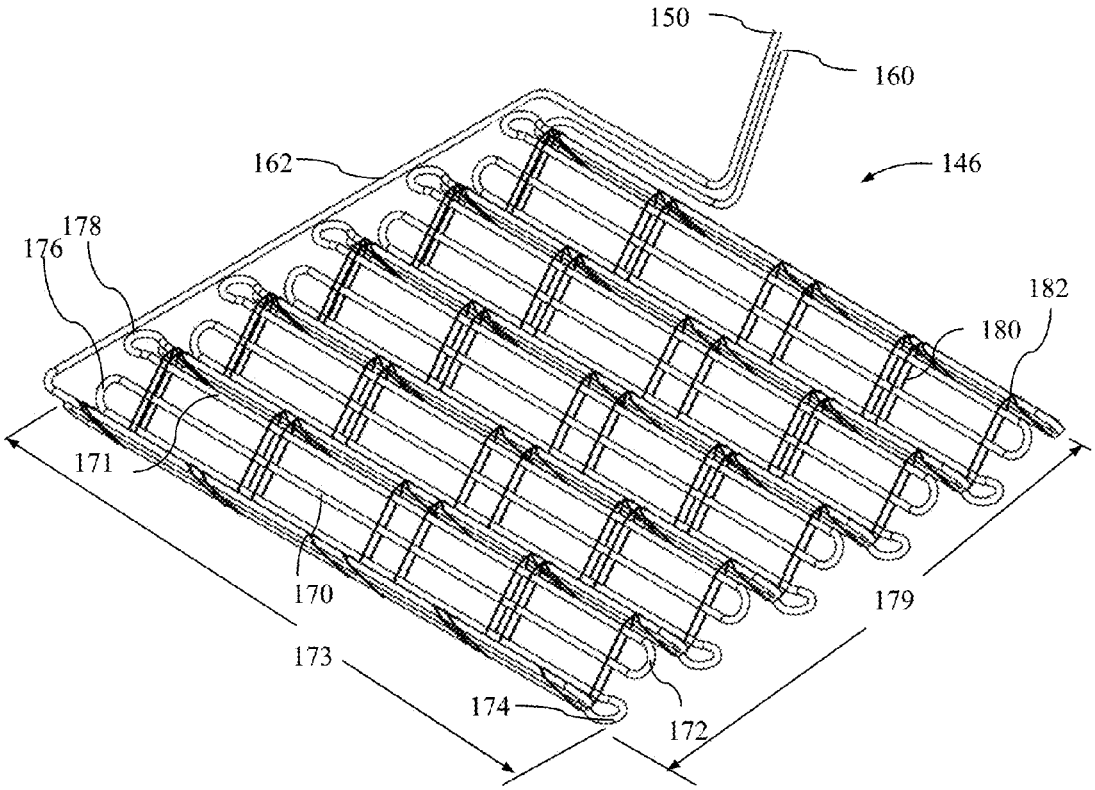
FIG. 6A shows a front upper left perspective view of a portion of a condenser assembly according to one aspect of the condenser assembly of the present invention.
Figure 6B:
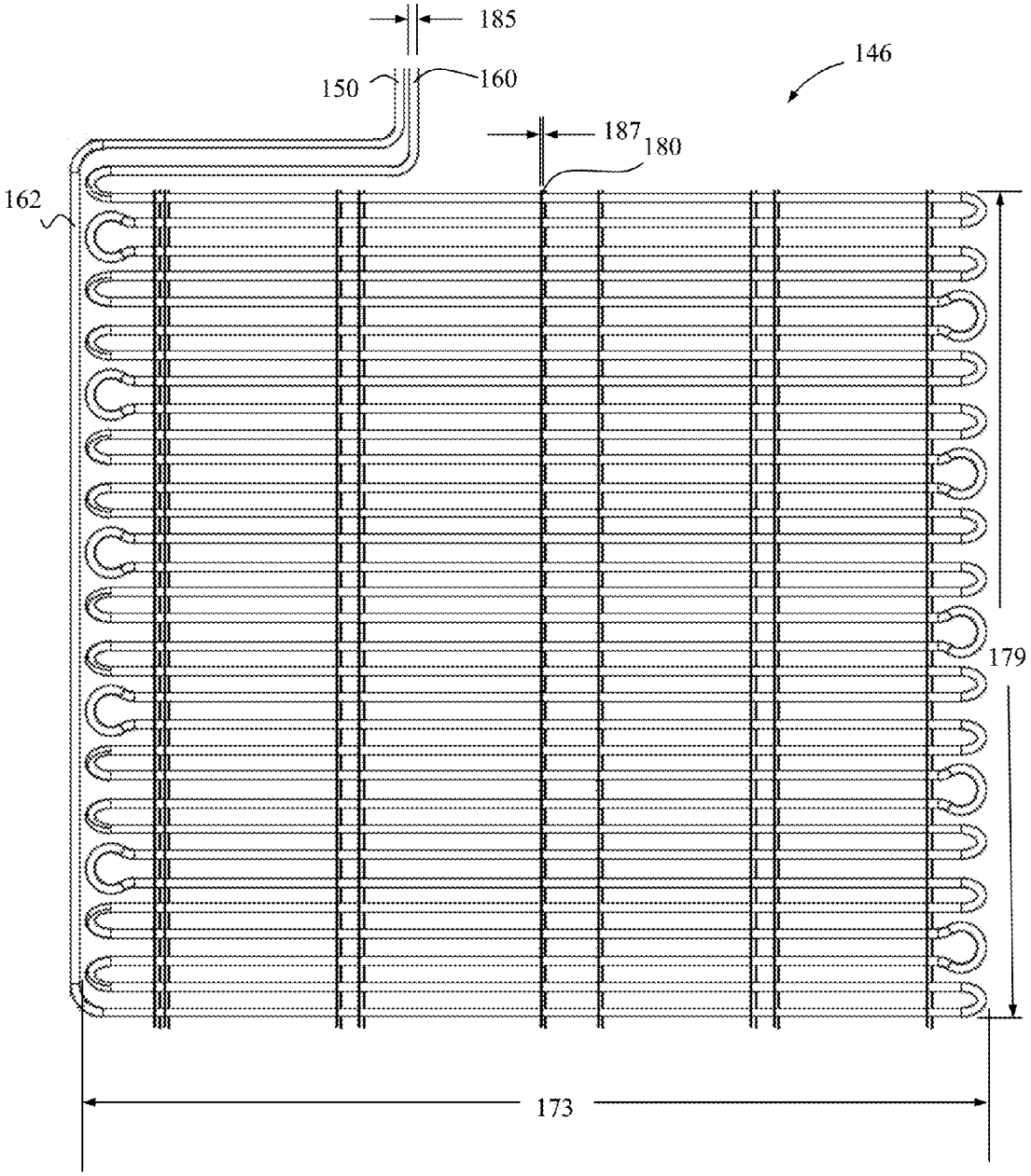
FIG. 6B shows a top view of the single condenser according to an aspect of the condenser assembly of the invention as shown in FIG. 6A.
Figure 6C:
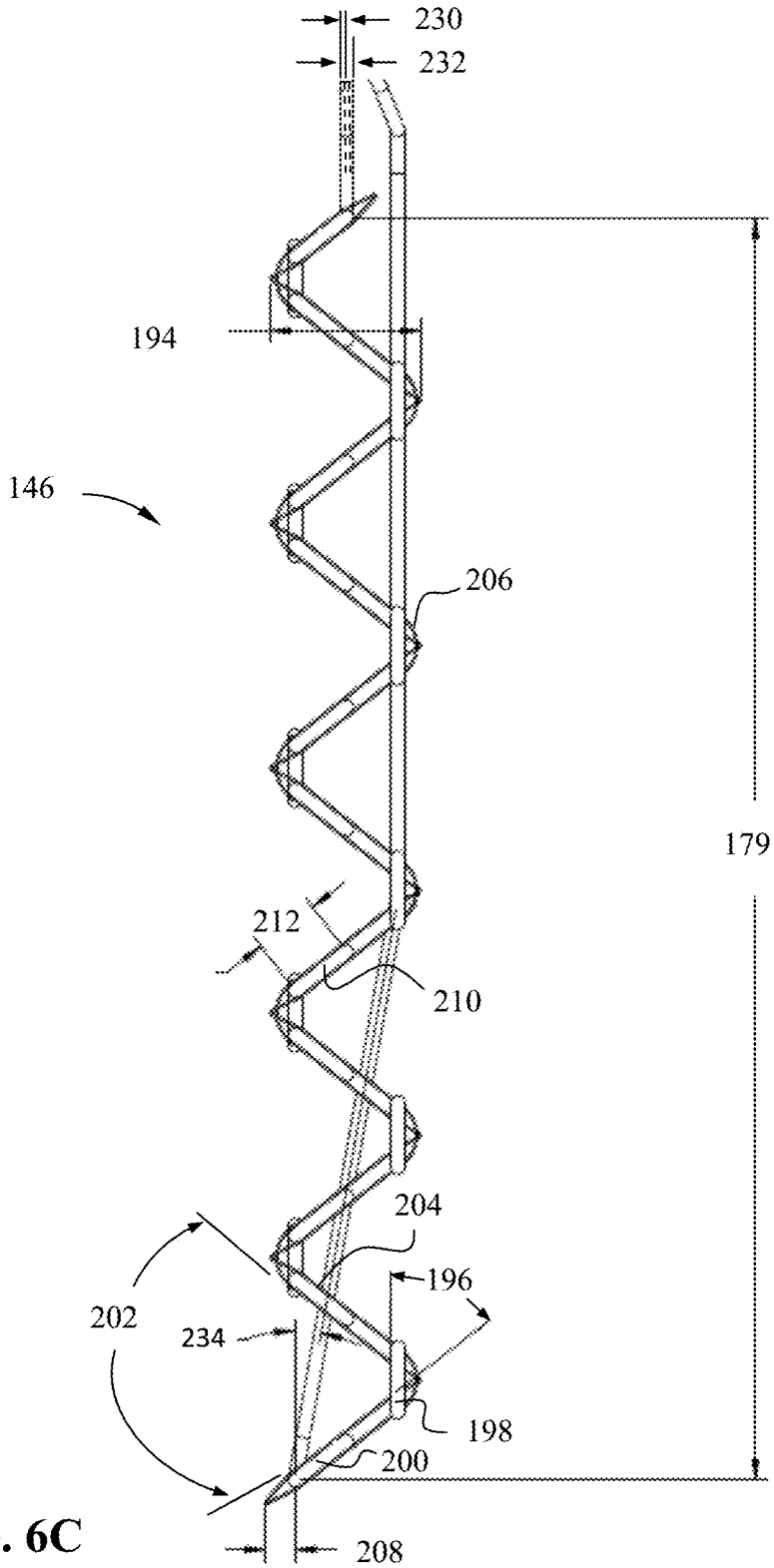
FIG. 6C shows an elevated right side view of the single condenser of the condenser assembly of the invention as shown in FIG. 6A.
Figure 6D:
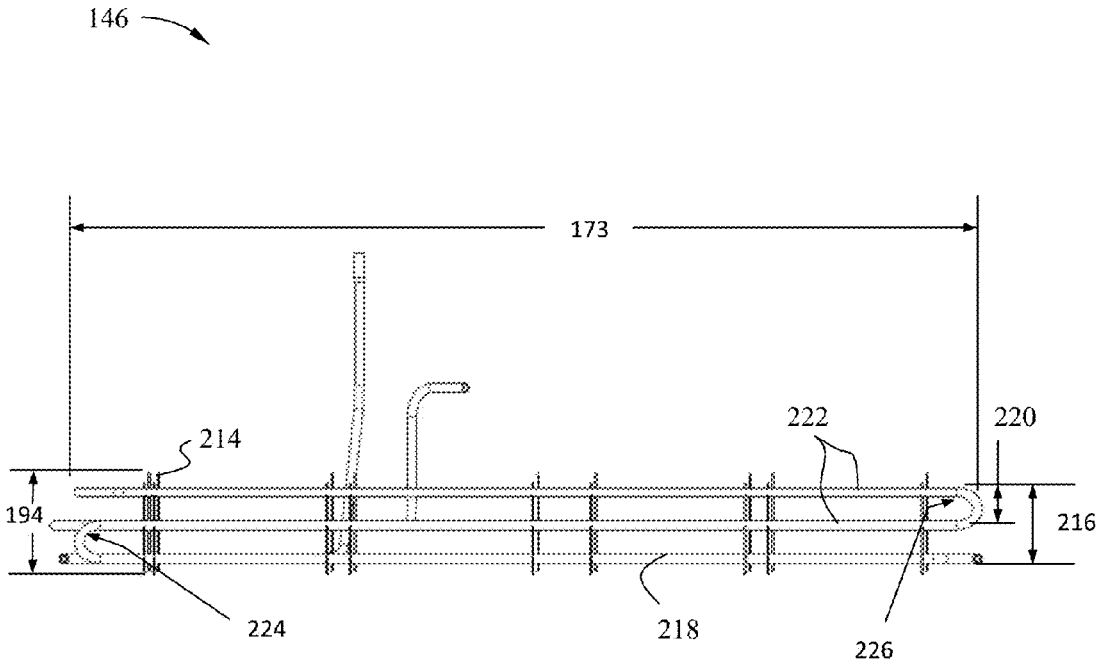
FIG. 6D shows an elevated front end view of the single condenser according to an aspect of the condenser assembly of the invention as shown in FIG. 6A.

FIG. 6A shows an example of a wire on tube condenser 146 with a sawtooth lateral profile suitable for use according to an aspect of the invention. The top view of the condenser 146 is shown in FIG. 6B. A side view of the condenser 146 is shown in FIG. 6C. A front view of the condenser 146 is shown in FIG. 6D.

The first condenser 146 typically includes a first condenser inlet 150, a first condenser outlet 160, and a tubular conduit 162 with a passageway therethrough and configured to carry one or more refrigerant(s). Typically, the tubular conduit 162 is a metal conduit, more typically a metal of high thermal conductivity such as steel, copper, aluminum, or the like. The refrigerant is typically a two-phase refrigerant and may be at least one of a fluid, a gas, or a liquid. At least a portion of the tubular conduit 162 is typically formed into a serpentine shape with the tubular conduit 162 having a plurality of U-shaped tube passes with each pass having at least two substantially straight tube sections 170, 171 joined by a U-shaped end cap section 172. The straight tube sections 170, 171 may be oriented across a width 173 of the condenser 146. The tubular conduit 162 has a flow path progressing from the first condenser inlet 150, through the plurality of U-shaped tube sections 171, 172, 174, 176, 178, making alternating back and forth passes in a direction along the width 173 of the condenser 146, progressing along a length 179 of the condenser 146, and progressing to the condenser outlet 160. The first condenser 146 further typically includes an extended heat transfer surface 180 arranged connected to the straight tube sections 170, 171 across the length 179 of the condenser 146. The extended heat transfer surface 180 may be a plurality of wires 182 wrapped around a length of the tubular conduit 162. A plurality of thermal transfer fins (not shown) may be in a thermally engaged relationship with the tubular conduits to facilitate heat dissipation to the air flowing past the tubular conduits, fins and the overall condenser or condenser assembly. The tubular conduit 162 (FIG. 6B) is typically made out of steel with a tubing outer diameter 185 of between about 2.0 mm and about 10 mm, more typically between about 3.5 mm and about 7.0 mm, and preferably about or exactly 4.76 mm. The tubular conduit 162 is typically made out of a tubing with a wall thickness 230 of between about 0.4 mm and about 2.0 mm, more typically between about 0.5 mm and about 1.0 mm, and preferably about or exactly 0.63 mm.

The tubular conduit 162 (FIGS. 6B and 6C) is typically configured into a serpentine pattern with a lateral profile of a sawtooth. The width 173 of the condenser 146 is typically less than about 1500 mm, more typically less than about 1000 mm, and preferably less than about 500 mm and most preferably about or exactly 479 mm. The length 179 of the condenser 146 is typically less than about 1500 mm, more typically less than about 1000 mm, and preferably less than about 500 mm, and most preferably about or exactly 440 mm. The height 183 of the condenser 146 (FIG. 5) is typically less than about 200 mm, more typically less than about 150 mm, and preferably less than about 75 mm.

The condenser 146 (FIG. 6B) has typically between about 3 to about 15, more typically between about 5 to about 12, and preferably about 6 to about 10 substantially straight sections 170 of U-shaped passes 171 per about 100 mm of condenser length 179. The number of substantially straight sections 170 of U-shaped passes 171 per unit of condenser length 179 may vary within a condenser 146. The contour of each U-shaped pass 171, the orientation of each U-shaped end cap section 172, the bend radius of each U-shaped end cap section 172, the distance between each U-shaped end cap section 172, the inverted angle 147, and the upward facing angle 151 affect the amount of U-shaped passes 171 per unit of condenser length 179.

The contour of the individual U-shaped passes 171, the radius of the U-shaped end cap sections 172, the length of the individual substantially straight sections 170, the condenser width 173, the condenser length 179, the condenser height 183, and the tubular conduit 162 tube diameter 185 may be and typically are substantially similar or identical between the at least two condensers 146, 148, may be substantially different between the at least two condensers 146, 148, and optionally may vary within a specific condenser 146. Likewise, the placement, profile, wire diameter 187, wire material, and number of wires 180 may vary between the at least two condensers 146, 148. The tubular conduit 162 may be any suitable cross-sectional shape including: round, substantially oval, oval, oblong, parallelogram, or rectangular over at least a portion of the tubular conduit length. The tubular conduit 162 has a conduit diameter 185 and the wires 180 of the condenser having a wire diameter 187 (FIG. 6B). Wires 180 are typically steel wires with a diameter of typically between about 0.5 mm and about 2.0 mm, more typically between about 0.8 mm and about 1.5 mm, and preferably about or exactly 1.39 mm wire diameter 187 (outer surface to opposite outer surface). The wires 180 are typically attached across the length 179 of the serpentine tubular conduit 162. Typically between about 10 and about 400, more typically about 100 to about 300, and preferably about or exactly 148 wires are distributed over the upper and lower surfaces of the serpentine tubular conduit 162. While the wire 180 typically has a circular or substantially circular cross-section, the wire could also have another cross-sectional shape such as a rectangle, square, or diamond shape cross-section.

FIG. 6C shows a side perspective view of the condenser 146 according to one embodiment of the invention as shown in FIG. 6A. The condenser 146 has a length 179 and an overall wire height 194. An angle 196 is measured between a U-shaped tubular section 198 parallel to the general plane of the condenser 146 and an adjacent U-shaped tubular section 200. The angle 196 is typically from about 20 to about 160 degrees, more typically from about 35 to about 120 degrees and most typically about or exactly 54 degrees. A profile angle 202 is the angle between a U-shaped tubular section 200 located off the general plane of the condenser 146 and an adjacent U-shaped tubular section 204 located off the general plane of the condenser. The profile angle 202 is typically from about 20 to about 160 degrees, more typically from about 30 to about 140 degrees, even more typically from about 35 to about 150 degrees, even more typically from about 50 to about 110 degrees, and most typically about or exactly 72 degrees. The wires 206 extend past the U-shaped tubular passes 200 a distance 208 and meet one another where they are engaged via a weld, a mechanical attachment, a crimp, glue, or other bonding mechanism. The wires 206 extend past the tubular U-shaped sections 198, 204 typically between about 1 mm and about 25 mm, more typically between about 5 mm and about 20 mm, and preferably about or exactly 12 mm. Each tubular U-shaped pass 210 has a width 212. The width of each tubular U-shaped pass 210 may be approximately uniform across all of the tubular U-shaped passes 210 or the widths of the various tubular U-shaped passé 210 may be varied.

FIG. 6D shows an elevated front-end view of the condenser 146 shown in FIG. 6A. The overall height 194 of the wires 214, the overall height 216 of the tubular conduit 218, the width 220 of each tubular U-shaped pass 222, and the width 173 of the condenser 146 are illustrated. The bend radiuses 224, 226 of the tubular U-shaped passes 222 are also illustrated. Each tubular U-shaped pass 222 consists of two straight sections 218 separated by a radius bend 224.

Referring to FIG. 6C and FIG. 6D, the distance 212 between two adjacent straight sections 222 is typically between about 5 mm and about 40 mm, more typically between about 15 mm and about 30 mm, and preferably about or exactly 22 mm. The overall height 194 of the condenser 146 measured across the wires 206 is typically between about 30 mm and about 100 mm, more typically between about 40 mm and about 70 mm, and preferably about or exactly 52 mm. Each of the condensers 146, 148 (see FIGS. 5 and 6A-6D) typically have an inclined portion 238 and a declined portion 240 that invert about the top side bend at an angle 242 and an upwardly facing bottom bend at an angle 244. The inverted angle 242 is typically between about 20 to about 160 degrees, more typically between about 35 to about 150 degrees and most typically about or exactly 72 degrees. The upward facing angle 244 is typically between about 20 to about 160 degrees, more typically between about 35 to about 150 degrees and meet typically about or exactly 72 degrees. The inverted angle 242 and the upward facing angle 244 may be substantially about the same or identical or may vary within a condenser.

Figure 7A:
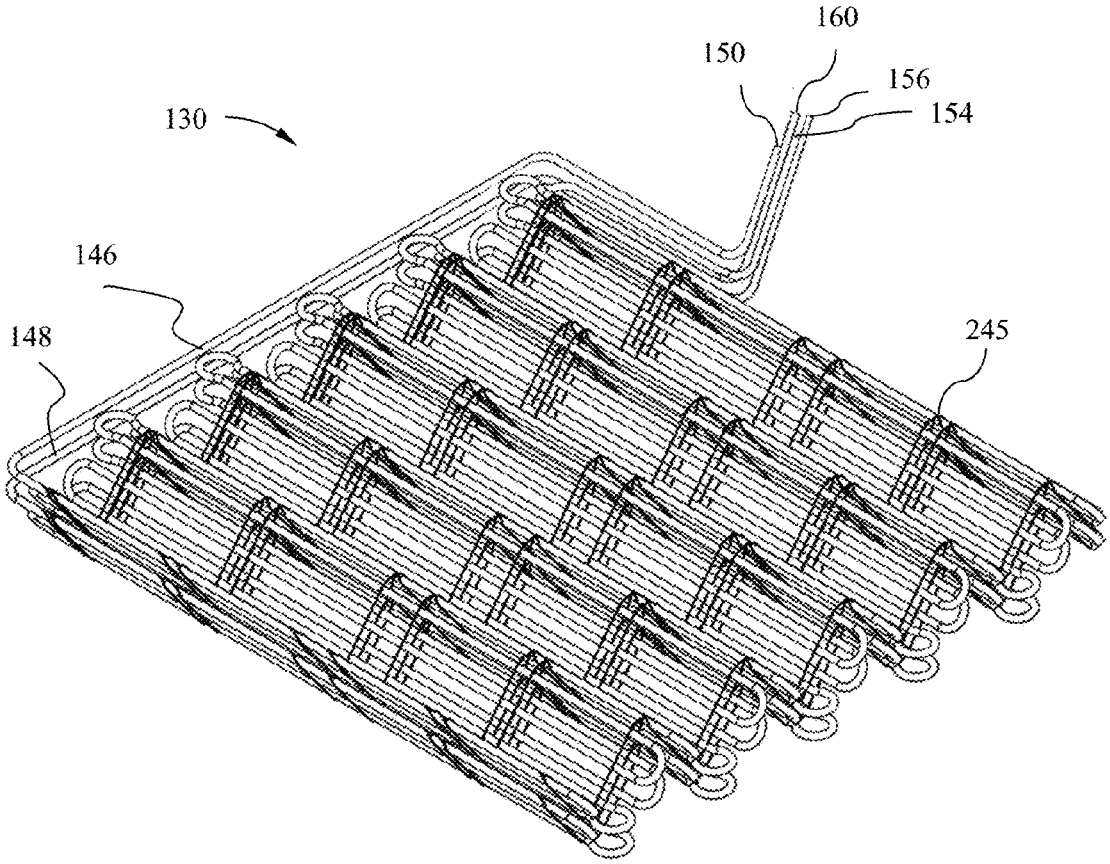
FIG. 7A shows an upper left perspective view of a compact condenser assembly according to one aspect of the condenser assembly of the present invention.
Figure 7B:
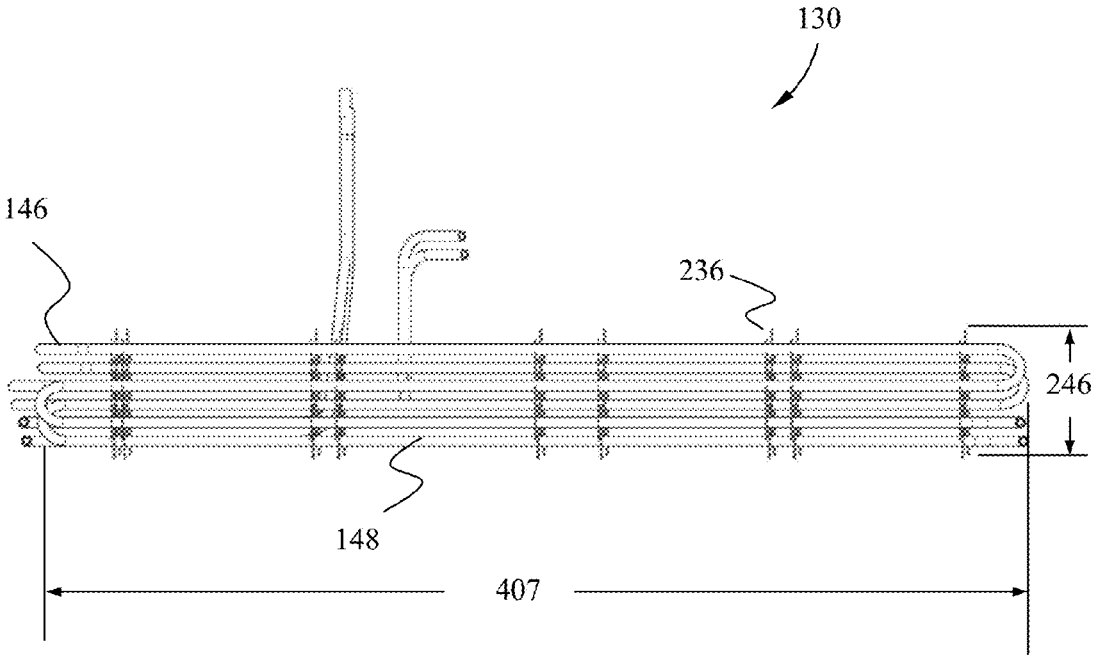
FIG. 7B shows an elevated front view of a condenser assembly according to an aspect of the condenser assembly of the invention as shown in FIG. 7A.
Figure 7C:
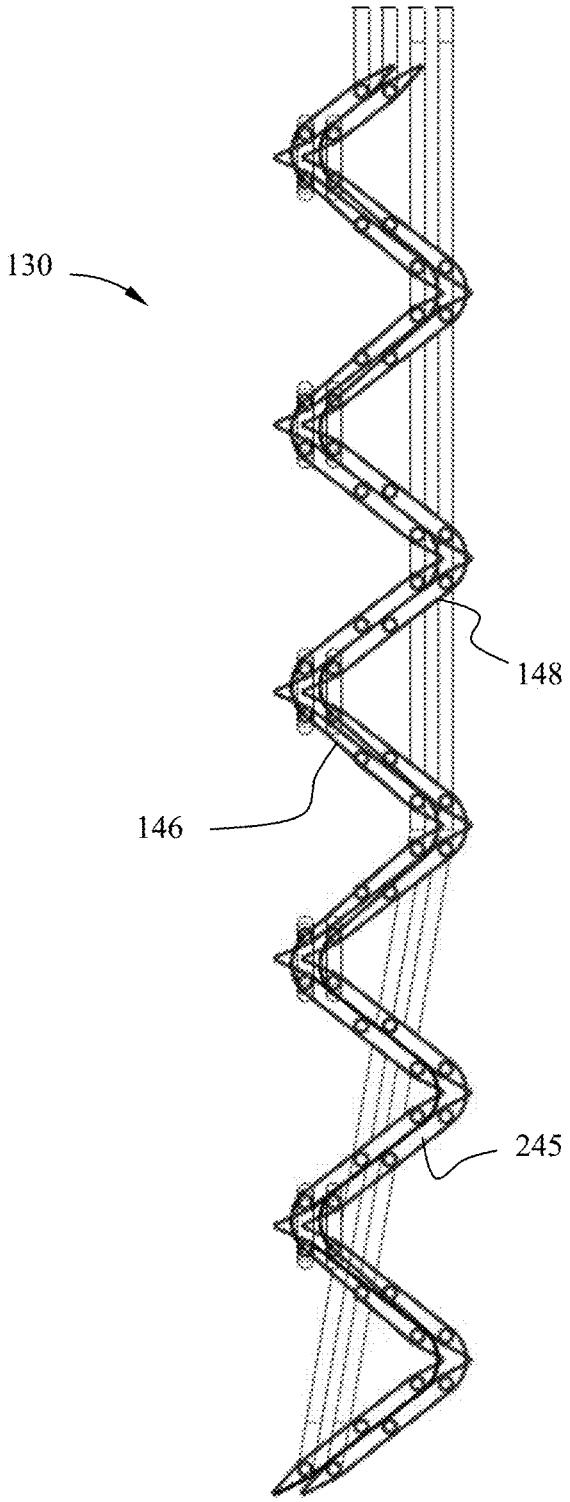
FIG. 7C shows an elevated right view of the condenser assembly according to an aspect of the condenser assembly of the invention as shown in FIG. 7A.

Referring to FIGS. 7A-7C, a condenser assembly 130 typically employs at least two sub-condensers 146, 148. The condenser assembly 130 typically includes at least a first condenser 146 and a second condenser 148 but may employ additional sub-condensers beyond the first 146 and second 148 condensers. FIGS. 7A-7C show a condenser assembly 130 where two separately and independently produced wire on tube condensers 146, 148 have been substantially locked together and positioned in a matingly engaged, typically frictionally matingly engaged, configuration forming the condenser assembly 130 according to one embodiment of the invention. FIG. 7C shows the alignment of the first condenser 146 and the second condenser 148 of FIG. 7A. Some of the wires 245 typically employed have been omitted from the Figures for clarity. As shown in FIG. 7A, the condenser assembly 130 typically has a first condenser inlet 150, a first condenser outlet 160, a second condenser inlet 154, and a second condenser outlet 156. The length and width dimensions of the condenser assembly 130 are about the same as for a single condenser 146 due to the interlocking of the condensers 146, 148.

The overall height 246 of the condenser assembly 130 (FIG. 7B) when two condensers are employed to form the condenser assembly 130 is typically between about 40 mm and about 150 mm, more typically between about 50 mm and about 100 mm, and preferably about or exactly 63 mm. The increase in height of a condenser assembly 130 over a single condenser 146 is typically between about 5 mm and about 50 mm, more typically between about 8 mm and about 20 mm, and preferably about or exactly 11 mm (for each additional condenser added to form the condenser assembly). The increase in overall height of the condenser assembly is related to the number of condensers 146 layered to form a condenser assembly 130 and the contour of the individual condensers 146. A stack of three condensers may have an increase in height over a stack of two condensers. When two substantially similar condensers 146 are assembled into a condenser assembly 130, the heat transfer surface area may be doubled with only about 5 mm to about 30 mm increase in overall condenser assembly height.

The energy usage was measured on two refrigerators with a single condenser. The energy usage was measured after the refrigerators were fitted a condenser assembly with two condensers connected in series.

Exemplary energy usage is provided in Tables I and III from the two side by side refrigerators of the same model (WHIRLPOOL® GSS26C4XXW03) when tested in accordance with AHAM HRF-1-2007 (Section 8). Unit 1 and Unit 2 were fitted with a single condenser and evaluated for energy usage. Exemplary energy usage is provided in Tables II and IV from Unit 1 and Unit 2 fitted with two substantially similar condensers connected in series.

TABLE I

Exemplary energy usage for a single condenser in unit 1

| Test | Freezer Temperature ° F. | Cabinet Temperature ° F. | Energy Usage kW-hr/Day |
|---|---|---|---|
| 1 | −3.2 | 41.4 | 1.73 |
| 2 | 3.3 | 49.7 | 1.44 |
| 3 | 5.0 | 51.9 | 1.36 |
| 4 | −0.4 | 45.0 | 1.61 |

TABLE II

Exemplary energy usage for a single condenser in unit 2

| Test | Freezer Temperature ° F. | Cabinet Temperature ° F. | Energy Usage kW-hr/Day |
|---|---|---|---|
| 1 | −0.5 | 38.3 | 1.61 |
| 2 | 6.0 | 48.4 | 1.30 |
| 3 | 5.0 | 46.8 | 1.35 |
| 4 | 3.8 | 45.0 | 1.40 |

TABLE III

Exemplary energy usage for a condenser assembly of the present disclosure with two condensers connected in series in unit 1

| Test | Freezer Temperature ° F. | Cabinet Temperature ° F. | Energy Usage kW-hr/Day |
|---|---|---|---|
| 1 | −3.3 | 41.3 | 1.71 |
| 2 | 2.9 | 49.3 | 1.43 |
| 3 | 5.0 | 52.0 | 1.33 |
| 4 | −0.4 | 45.0 | 1.58 |

TABLE IV

Exemplary energy usage for a condenser assembly of the present disclosure with two condensers connected in series in unit 1

| Test | Freezer Temperature ° F. | Cabinet Temperature ° F. | Energy Usage kW-hr/Day |
|---|---|---|---|
| 1 | −0.3 | 39.4 | 1.54 |
| 2 | 5.9 | 48.5 | 1.26 |
| 3 | 5.0 | 47.1 | 1.30 |
| 4 | 3.5 | 45.0 | 1.37 |

The freezer temperature and the cabinet temperature show the average freezer compartment air temperature and the average fresh food compartment air temperature, respectively, in degrees F. as measured per AHAM HRD-1-2007 (Section 8). The Energy Usage is the energy consumption in kW-hr/day as measured per AHAM HRD-1-2007. Comparing the energy usage at similar average compartment temperatures shows the condenser assembly connected in series used about 0.69% to about 4.3% less kw-hr/day during any given test. The average energy usage for a single condenser was 1.475 kW-hr/day. The average energy usage for a condenser assembly connected in series was 1.44 kW-hr/day. Based on this data, an average energy savings of about 2.3% was obtained by using a condenser assembly of the present disclosure employing two nested condensers over a single condenser.

This exemplary data shows that by using a condenser assembly of the present disclosure employing two nested condensers an overall reduction in energy usage was obtained. The overall width and length of the condenser assembly was substantially similar to the overall width and length of a single condenser. The overall height of the exemplary condenser assembly increased about 11 mm. Depending on the available clearance in an air passageway, the condenser assembly may fit within the air passageway with no changes to the air passageway.

Figure 8:
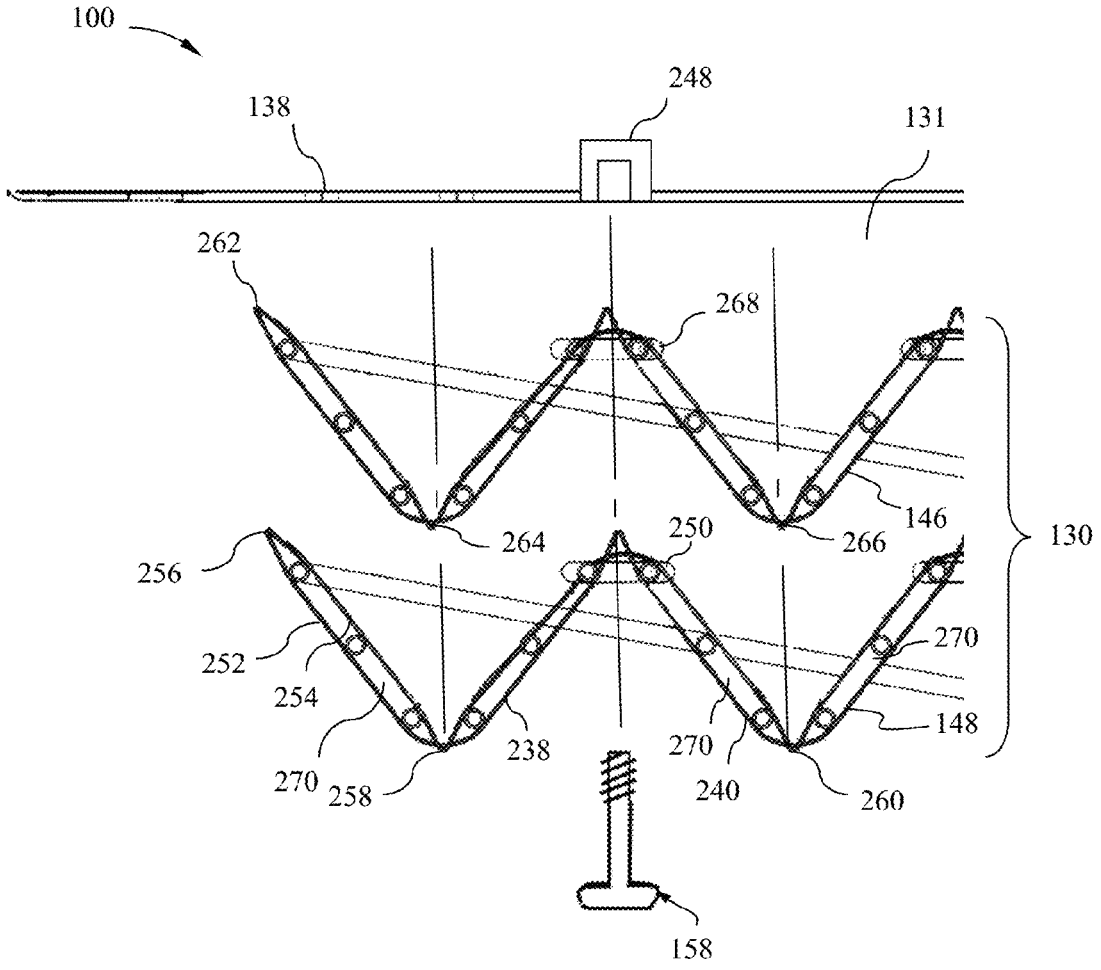
FIG. 8 shows a side cross-section exploded view of the condenser assembly elements of the present invention and the surface of the machine compartment of the appliance the condenser assembly engages according to one aspect of the condenser assembly of the present invention.

As discussed above, the first condenser 146 and the second condenser 148 may be affixed to a surface of the air passageway 131 or machine compartment 122 or other surface of the appliance 100 using one or more fasteners 158 (FIG. 8). The one or more fasteners 158 typically are a threaded bolt, screw, clip, pin, bracket, brace, or the like that passes through apertures in the first condenser 146 and second condenser 148 typically at the top side bend portion(s). The at least one fastener 158 is typically matingly engaged with an attachment recess or aperture of an attachment portion 248 that receives the fastener 158. The tubular conduit inclined portions 238 and declined portions 240 have U-shaped portions off the general plane of the condenser 148 and a U-shaped portion 250 aligned or substantially aligned with the general plane of the condenser 148. The wires 252, 254, the upper tip of the wires 256, and the wire lower bends 258, 260 of the second condenser 148 are aligned with the upper tip of the wires 262 the wire lower bends 264, 266 of the first condenser 146. When assembled, the tubular conduit U-shaped passes 250, 268 in the general plane of the condenser 146, 148 may align with each other and provide a planar mounting surface for the fastener(s) 158, when fasteners are employed.

Referring to FIG. 8, the first condenser 146 is inserted into the air passageway 131. The second condenser 148 is aligned and positioned in matingly engaged configuration with the first condenser 146. A fastener 158 may be inserted through the tubular conduit U-shaped pass 250, 268 to fasten the condenser assembly 130 to the air passageway 131. At least one of a valve or a connector (not shown) for the condenser assembly 130 may then be assembled into operative engagement with the condenser assembly 130.

Figure 9A:
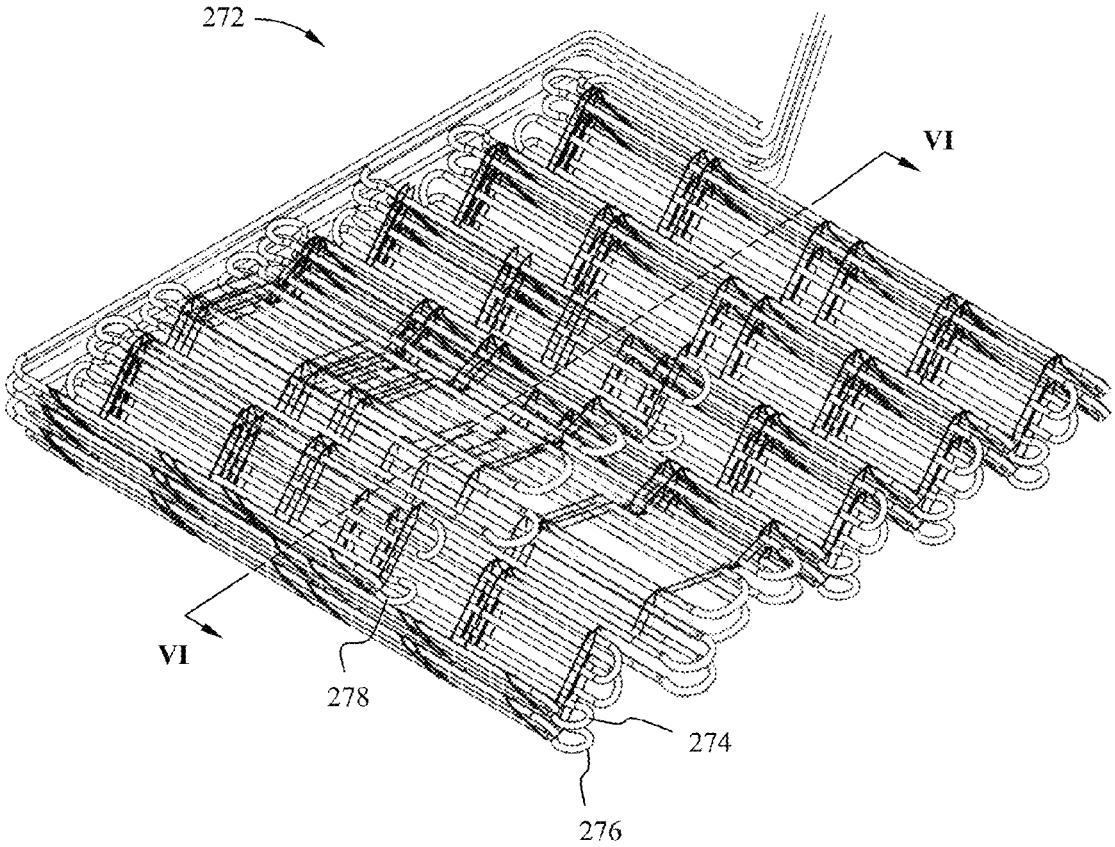
FIG. 9A shows an upper left perspective view of a compact condenser assembly having three layers with the top layer smaller than the other two layers according to one aspect of the condenser assembly of the present invention.
Figure 9B:
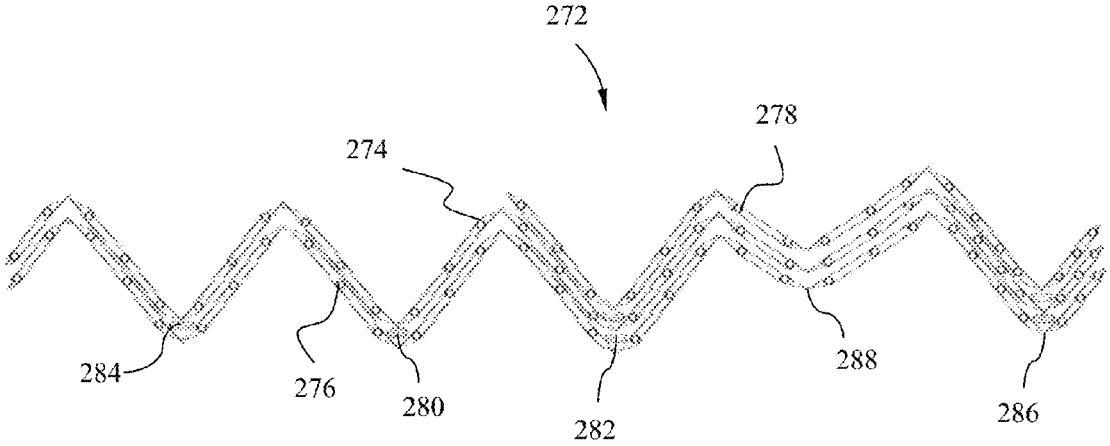
FIG. 9B shows an elevated cross-sectional view of the portion of the condenser assembly taken along line VI-VI in FIG. 9A according to an aspect of the condenser assembly of the present invention.

As shown in FIG. 9A, a condenser assembly 272 according to an embodiment of the invention includes a first condenser 274, a second condenser 276, and a third condenser 278. Optional spacers 280, 282, 284 may be located between the condensers 274, 276, 278 (see FIG. 9B). The condensers 274, 276, 278 are sub-condensers of the overall condenser assembly 272. These condensers are shown in FIG. 9B and profiled in such a way as to present from a side view and relative to at least one part of its length an inclination in the direction of which is suddenly inverted 286 at least once relative to a plane which is substantially parallel to the general plane of the condensers 274, 276, 278. The condensers 274, 276, 278 typically have a second inclination of which is progressively inverted 288 compared to and relative to the sudden invention 286 at least once relative to a plane, which is substantially parallel to the general plane of the condenser 276. The profile of the condensers 274, 276, 278 or the profile of any of the condensers of a condenser assembly 272 according to any aspect of the present invention may be adjusted based on the shape of the air passageway 131 and/or the machine compartment 122 and/or adjusted to fit around other components in the air passageway 131 or in the machine compartment 122.

Figure 10:
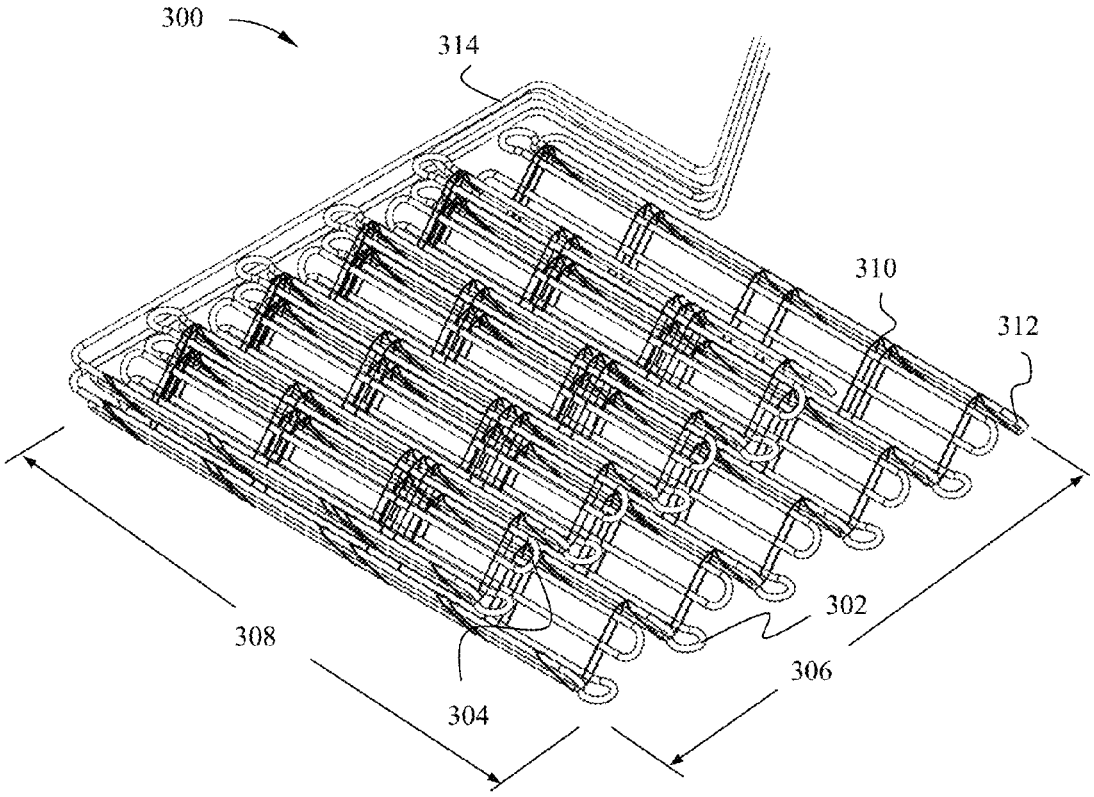
FIG. 10 shows an upper left perspective view of a condenser assembly according to yet another embodiment of the condenser assembly of the invention.

A condenser assembly 300 (FIG. 10) may include a first condenser 302 and a second condenser 304 having a similar or identical lateral profiles over at least a portion of the first condenser 302 and a portion of the second condenser 304. The first condenser 302 may have a longer or shorter length 306 and optionally a longer or shorter width 308 than the second condenser 304. The first condenser 302 and the second condenser 304 may have different amounts of wires 310, and varied placement of the wires 310 on the condensers 302, 304. Different configurations of U-shaped passes 312 of the tubular conduit 314 and optionally different amounts of tubular conduit 314 U-shaped passes 312 may also be employed. The first condenser 302 and the second condenser 304 are at least substantially locked and positioned in a matingly engaged (typically frictionally matingly engaged) configuration forming a condenser assembly 300 with a positional alignment between the first condenser 302 and the second condenser 304. The first condenser 302 and the second condenser 304 may be positioned in various configurations based on the application. The second condenser 304 may be aligned in any position and orientation where the lateral profiles of the two condensers 302, 304 are similar over at least a portion of both condensers 302, 304.

Figure 11:
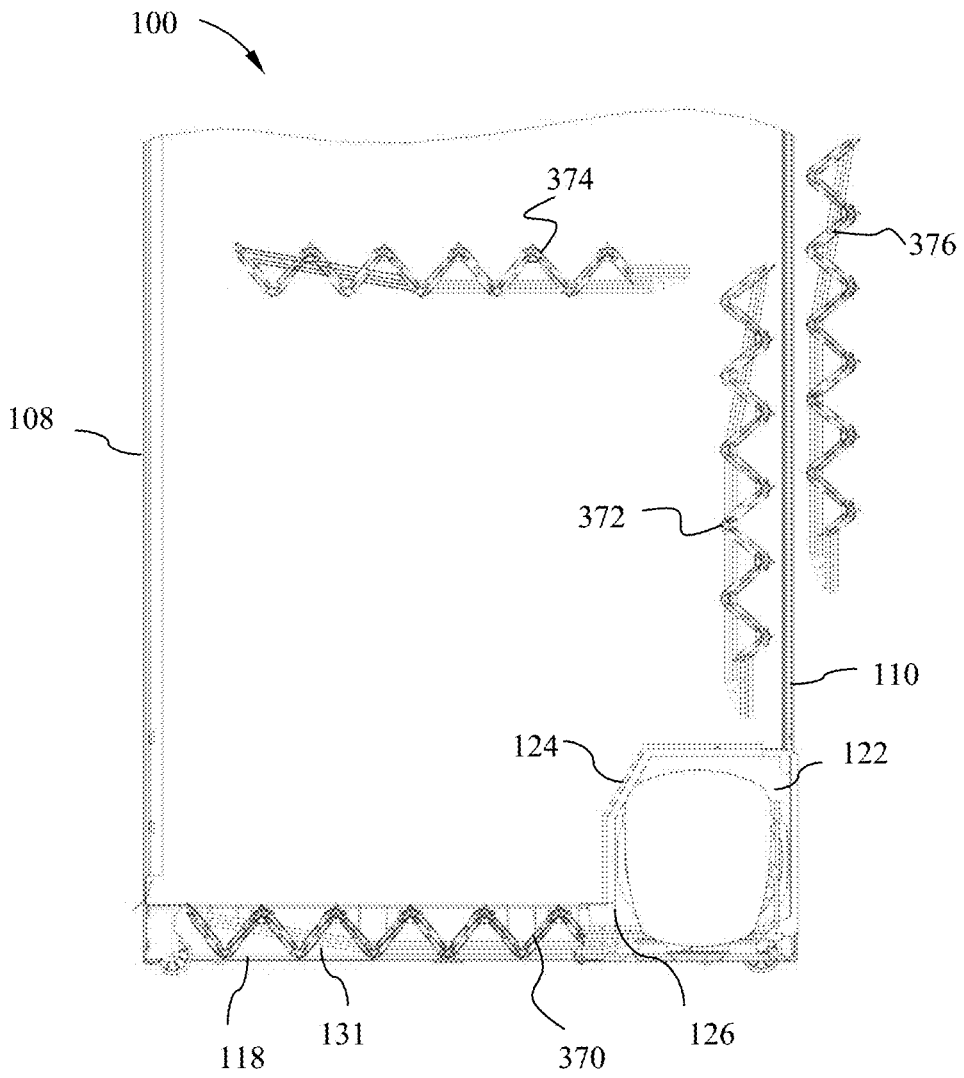
FIG. 11 shows an elevated cross-sectional view of a portion of an appliance with the condenser assembly in various optional locations.

A condenser assembly 130 may be positioned in a variety of alternate locations in an appliance 100 (FIG. 11). The condenser assembly 130 may be located in an air passageway 131 near the bottom of the appliance 370, along the back of the appliance 372 above the machine compartment 122, in the interior 374 of the appliance 100, near the top 116 of the appliance 100 (not shown), or on the exterior surface 376 of the appliance 100. The airflow over the condenser assembly 130 may be by natural convention or assisted by one or more than one fan (not shown).

Figure 12:
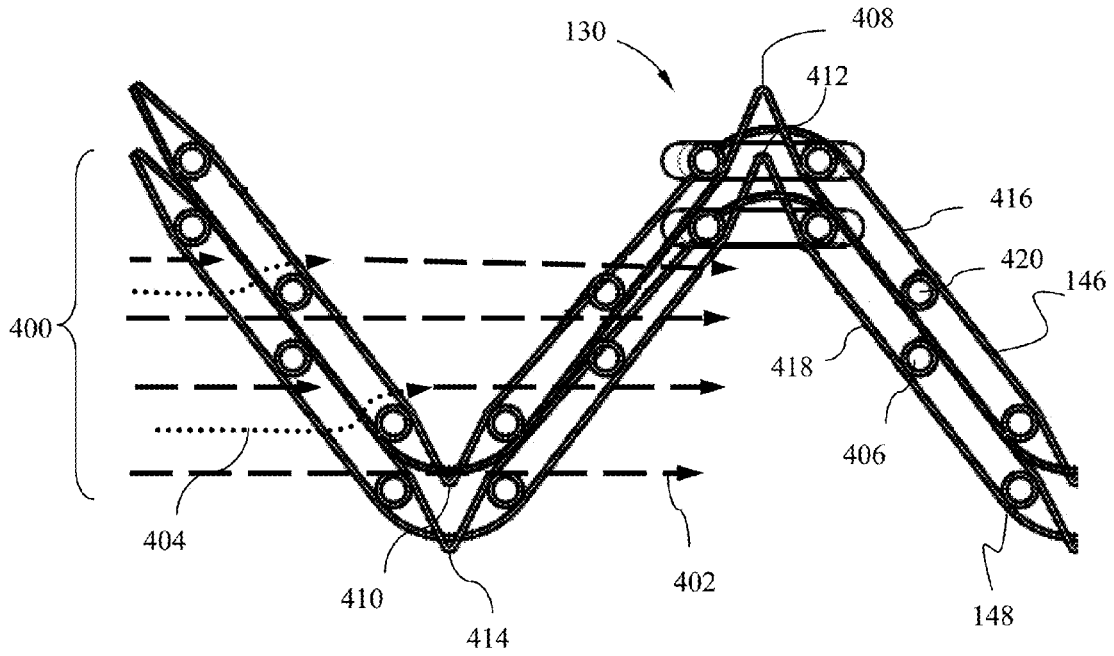
FIG. 12 shows a partial elevated cut away side view of the compact condenser assembly of FIG. 5 according to one aspect of the condenser assembly of the invention.

The airflow path 400 through the condenser assembly 130 is shown in FIG. 12. A portion, but typically multiple portions, of the airflow 402 moving generally substantially parallel from one side to the other across the condenser assembly is able to flow through the condenser assembly 130 unimpeded. A portion of the airflow 404 is obstructed by the tubular conduit 406 and is diverted around the tubular conduit 406. The air flowing through the condenser assembly 130 flows over additional tube segments 406 due to the plurality of sub-condensers 146, 148 that make up the overall condenser assembly 130. This increase in number of tube segments 406 increases the resistance to air flow and typically results in an increased air pressure drop.

The alignment of the at least two condensers 146, 148 in the condenser assembly 130 may be adjusted to minimize the air pressure drop. When the at least two condensers 146, 148 are at least substantially locked and positioned in a matingly engaged configuration where the at least two condensers 146, 148 are nested, stacked, spaced apart, or layered, the tubular conduit U-shaped passes are typically spaced in such a way that the airflow is distributed more evenly across the face area of the condenser assembly 130. The "face area of the condenser assembly" is the width 407 of the condenser assembly 130 multiplied by the height 246 of the condenser assembly 130 (FIG. 7B). This results in a more even distribution of the heat transfer across all the tubes and wires of the condenser assembly 130. Spacers may be used to adjust the airflow path through the condenser assembly 130.

The contour of each condenser 146, 148 can be adjusted to optimally improve the airflow and heat transfer when at least two condensers 146, 148 are stacked, nested, layered, spaced apart, or assembled together to form the condenser assembly 130. The wire tips 408, 410 of the first condenser 146 are typically aligned with the wire tips 412, 414 of the second condenser 148. The wire frame 416 of the first condenser 146 rests on the wire frame 418 of the second condenser 148. The tubular straight sections 420 of the first condenser 146 are typically offset from the tubular straight sections 406 of the second condenser 148.

Figure 13:
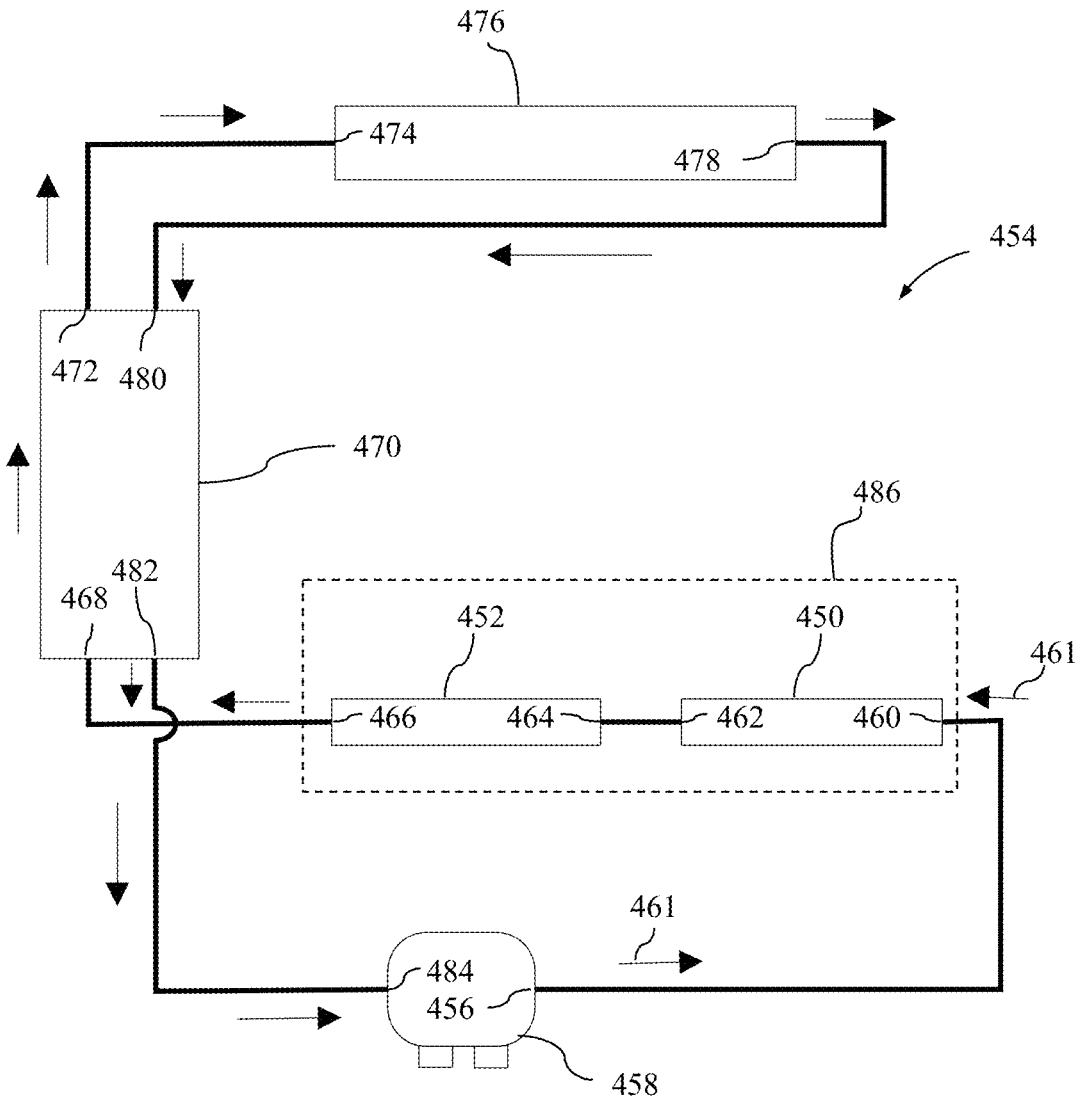
FIG. 13 shows a schematic view of an aspect of the condenser assembly of the present invention where the first condenser and the second condenser are operationally connected in series.

The first condenser 450 is operationally connected to a second condenser 452 in series in the schematic view of an appliance heat exchange circuit 454 shown in FIG. 13. The outlet 456 of a compressor 458 is operationally connected or engaged to the inlet 460 of the first condenser 450 to allow refrigerant flow 461. The direction of refrigerant flow 461 in the heat exchange circuit is shown with arrows 461. The outlet 462 of the first condenser 450 is operationally connected to the inlet 464 of a second condenser 452 to allow refrigerant flow. The outlet 466 of the second condenser 452 is operationally connected to the inlet 468 of an expansion device, such as a capillary tube, which is part of a suction line heat exchanger assembly 470 to allow refrigerant flow. The outlet 472 of the suction line heat exchanger 470 is operationally connected to the inlet 474 of an evaporator 476. The outlet 478 of the evaporator 476 is operationally connected to the inlet 480 on the return side or suction line of suction line heat exchanger assembly 470. The outlet 482 on the return side of the suction line heat exchanger 470 is operationally connected to the inlet 484 of the compressor 458.

Figure 14:
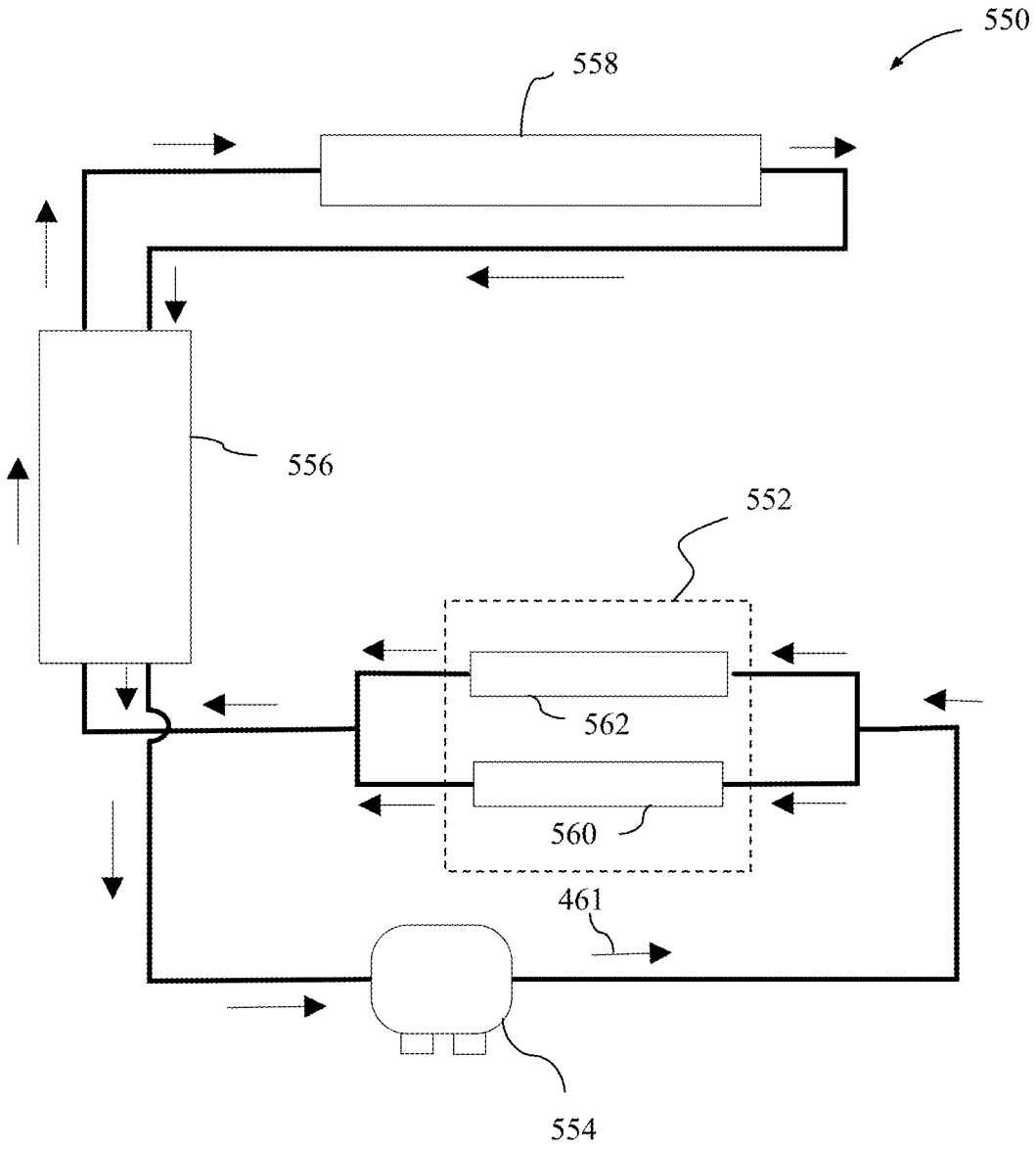
FIG. 14 shows a schematic view of an aspect of the condenser assembly of the present invention where the first condenser and the second condenser are operationally connected in parallel.

The heat exchange circuit 550 of FIG. 14 shows the inlets and outlets of the condenser assembly 552 operationally connected in parallel. The heat exchange circuit 554 includes a compressor 554, a condenser assembly 552, a suction line heat exchanger assembly 556, and an evaporator 558. The condenser assembly 552 includes a first condenser 560 and a second condenser 562 operationally connected in parallel. A suction line heat exchanger assembly 556 typically includes both an expansion device, such as a capillary tube (not shown), and a suction line (not shown). The heat exchange circuit 550 may include an expansion device (not shown) without having an optional capillary tube. A suction line heat exchanger assembly 556 typically includes a suction line in mechanical contact with a capillary tube in order to conduct heat away from the capillary tube to the suction line.

Figure 15:
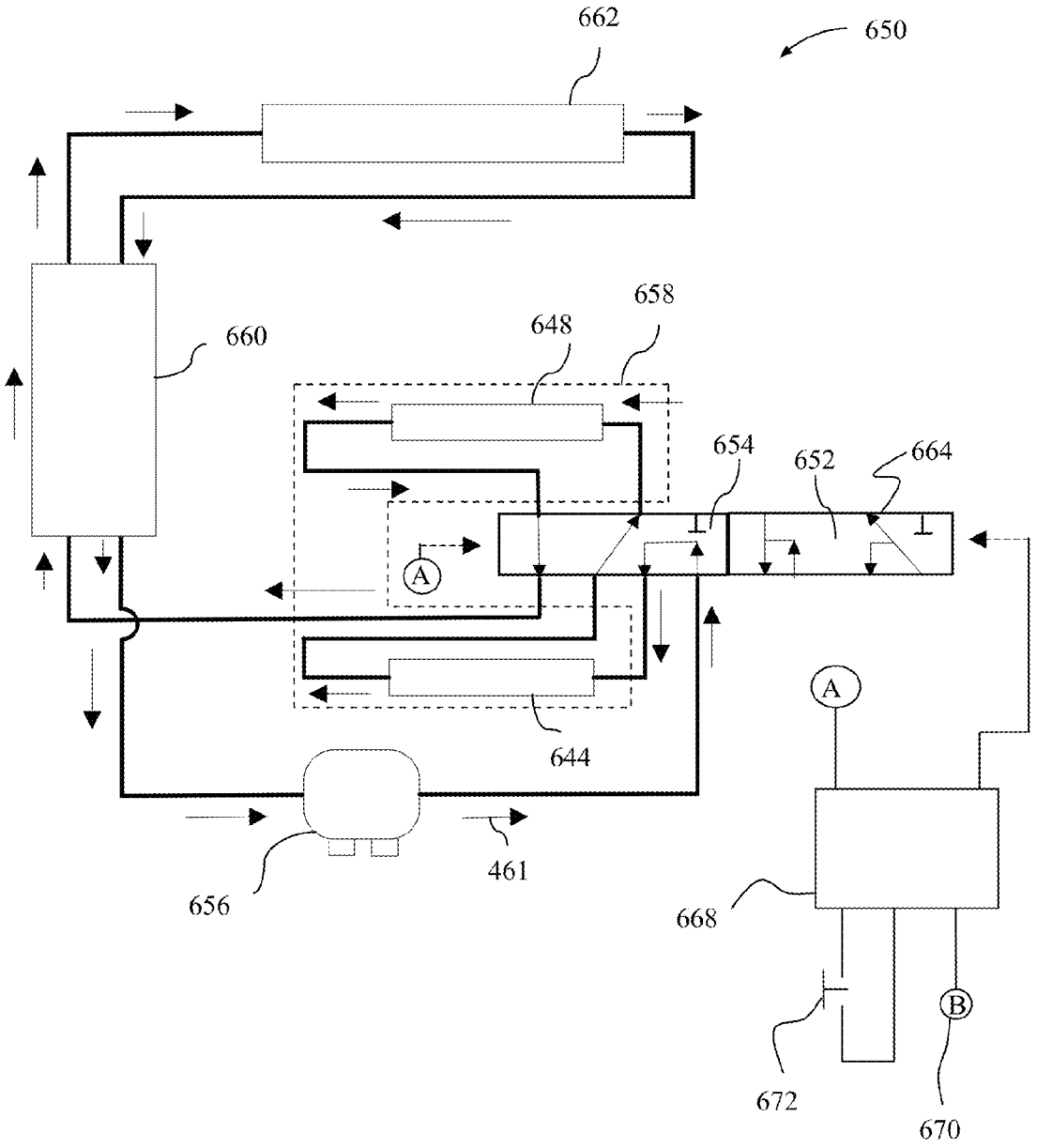
FIG. 15 shows a schematic view of an aspect of the condenser assembly of the present invention where the first condenser and the second condenser are operationally selectablely connected in series or in parallel.

The first condenser 644 and the second condenser 648 in a schematic view of an appliance heat exchange circuit 650 as shown in FIG. 15 may be selectably connected in parallel 652 or in series 654. The heat exchange circuit 650 typically includes a compressor 656, a compact condenser assembly 658, a suction line heat exchanger 660, and an evaporator 662. A two-position valve 664 is typically used to connect the first condenser 644 and the second condenser 648 operationally in parallel 652 or operationally in series 654. The appliance includes a controller 668 which can selectively operate the two-position valve 664 to switch between an operation mode where the system operates with the two-position valve 664 in the series position 654, and another operation mode where the system operates with the two-position valve 664 in the parallel position 652. The two-position valve 664 may be actuated electrically, mechanically, hydraulically, pneumatically, thermally, or the like. The two-position valve 664 may be moved from the series position 654 to the parallel position 652 (and vice versa) using a wax motor, a motor, a solenoid, an electrically operated switch, a spring, a timing cam, and the like. The two-position valve 664 is shown as laterally movable in FIG. 15. The controller 668 can selectively operate the two-position valve 664 automatically, based upon sensor input 670, and/or based on a user input such as a selectable switch 672. The controller 668 may be a computer system with a CPU and memory subsystem that stores code for use in synamically controlling the use of the condenser assembly 658. The controller 668 may be an electromechanical timer. The controller 668 may also employ one or more microprocessors, which typically incorporates the functions of a computer system's central processing unit (CPU) or a single integrated circuit (IC). In FIG. 15, the encircled "A" elements show where the controller 668 connects with the two-position valve 664 for clarity.

An appliance utilizing a condenser assembly may be configured to operate each individual condenser of the condenser assembly independently. Depending on the needs of the application, the appliance may be configured to operationally connect the at least two condensers in parallel, in series, or in a selectable configuration using valves or conduit connectors. The pairs of inlets and outlets of the individual condensers may be operationally connected to different heat exchange circuits, to different ports on a compressor, typically a two-stage compressor, linear compressor, or a variable speed compressor, or connected together as discussed previously. Alternatively, the selectable configuration may operationally reverse the direction of refrigerant flow through at least one of the individual condensers, restrict the amount of refrigerant flow through at least one of the individual condensers, and/or block refrigerant flow through at least one of the individual condensers.

The appliance may have a controller that selectively controls the flow of refrigerant through the condensers. The appliance may have at least one sensor to monitor the ambient air temperature, the refrigerant air temperature, the refrigerator air temperature, the freezer air temperature, the refrigerant pressure, and/or ambient humidity and the like. The controller may selectively control the at least one valve or connector based on the sensed input and/or based on input from one or more sensors, a timing chart, a switch, an algorithm, a cycle profile, a user selected input or option, opening or closing a door, drawer, or other access to the appliance interior, temperature of an internal volume in the appliance, ambient temperate outside of the appliance, an signal from outside of the appliance, thermal loading of an internal volume in the appliance, temperature or pressure of the refrigerant, a defrost step, an ice making step, time of day, time of year, energy consumption of the appliance, and the like.

Figure 16:
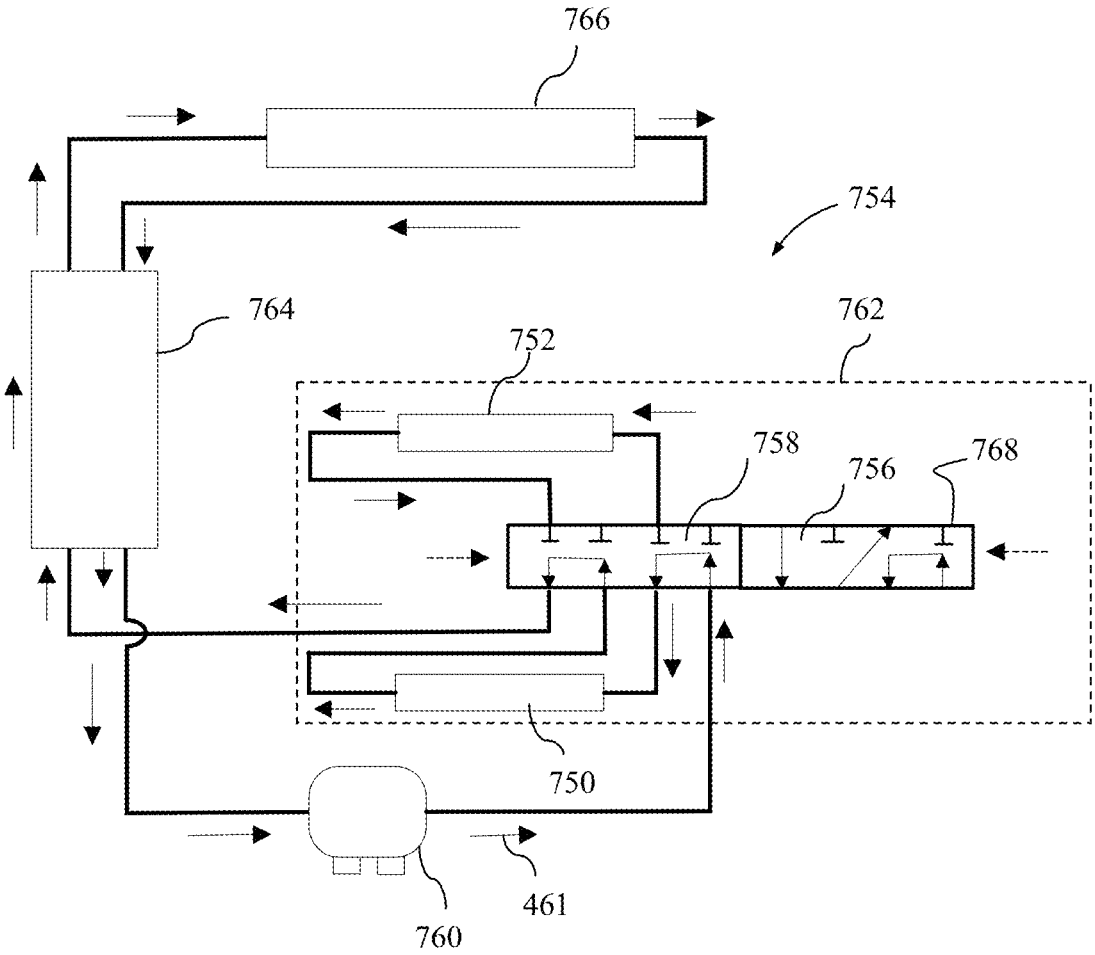
FIG. 16 shows a schematic view of an aspect of the condenser assembly of the present invention where the first condenser and the second condenser are operationally selectablely connected in series or in a mode bypassing the second condenser.

The first condenser 750 and the second condenser 752 of the schematic view of an appliance heat exchange circuit 754 of FIG. 16 may be selectably connected in series 756 or configured such that one of the condensers is bypassed 758. The heat exchange circuit 754 typically includes a compressor 760, a compact condenser assembly 762, a suction line heat exchanger 764, and an evaporator 766. A two-position valve 768 is used to connect the first condenser 750 and the second condenser 752 in a series configuration when the two-position valve 768 is in the series position 756. The first condenser 750 and the second condenser 752 are connected in a bypass configuration when the two-position valve 768 is in the bypass position 758. The two-position valve 768 is shown in FIG. 16 assembled as part of the condenser assembly 762. The appliance may have a controller (not shown) to selectively operate the two-position valve 768.

Figure 17:
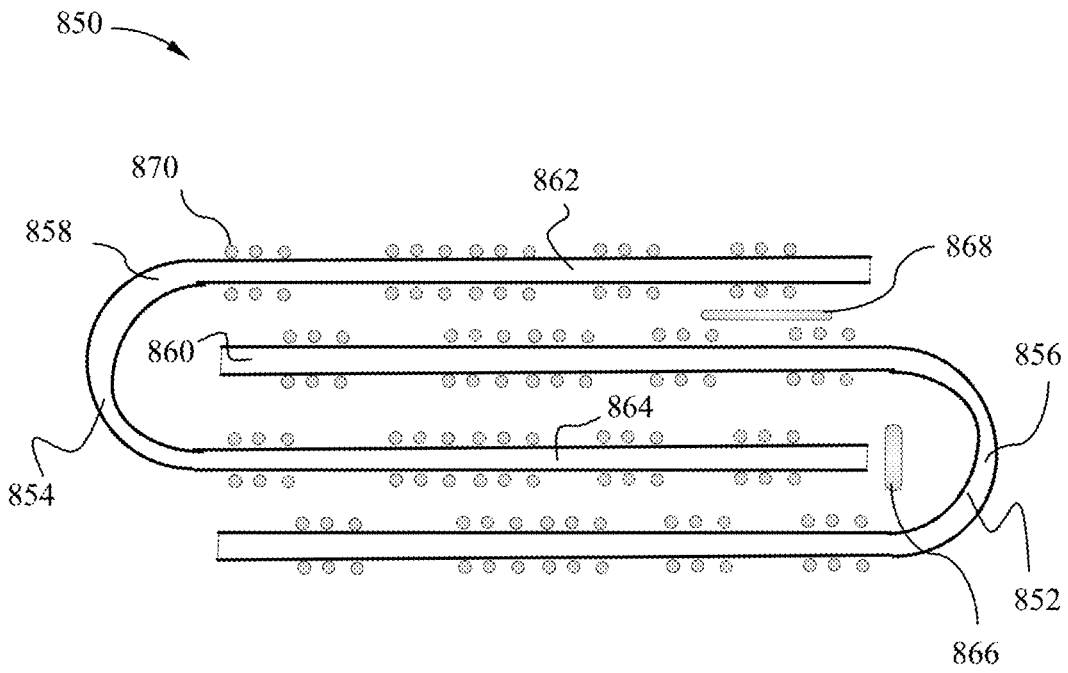
FIG. 17 shows a cut away side perspective view of the condenser assembly of the present invention according to an alternate embodiment where two condensers with a U-shaped lateral profile are assembled together to form a condenser assembly.

As shown in FIG. 17, a condenser assembly 850 may employ two condensers 852, 854 each having a cross-section U-shaped profile 856, 858 where both condensers are nested together to form the condenser assembly 850 by inserting a straight section 860 of one condenser 852 into the space between the two straight sections 862, 864 of the second condenser 854. Optional spacers 866, 868 are shown.

A condenser assembly increases the amount of heat transfer surface area while minimizing the increase in the overall dimensions of the condenser assembly. The condenser assembly can be assembled as a unit and then placed into an appliance as a unit. Alternatively, the condensers can be assembled into the appliance individually and then fastened to each other or fastened to one or more mounting surfaces. The individual condensers may be positioned in a matingly engaged configuration in the appliance without using fasteners or spacers.

The at least one of a valve or a connector between the inlets and outlets of the individual condensers in the condenser assembly, may be assembled into the condenser assembly prior to placement in an appliance. Alternatively, the at least one of a valve or a connector may be assembled as part of the appliance. The inlets and outlets of the condenser assembly may be connected to the at least one of a valve or a connector when the condenser assembly is located in the appliance or before the condenser assembly is placed into the appliance.

By using at least two separately and independently produced condensers to form a condenser assembly, the individual condensers may be used as a sole condenser in certain applications where less heat transfer surface area is needed, but also used as a modular system for multiple appliances or when greater heat transfer surface area is more beneficial based upon appliance configuration or energy efficiency or both.

The above description is considered that of the preferred embodiment only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A wire on tube condenser assembly comprising:

a first individual wire on tube condensers and a second individual wire on tube condenser, where each of the individual wire on tube condensers has a condenser inlet and a condenser outlet;

wherein the individual wire on tube condensers are at least substantially locked and positioned in matingly engaged plural inverted V-shaped configurations forming the condenser assembly; and wherein the individual wire on tube condensers are configured to be operationally connected;

wherein each of the individual wire on tube condensers further comprise a tubular conduit comprising a plurality of substantially straight tube sections interconnected by a plurality of U-shaped tube passes, wherein a first substantially straight tube section of the first individual wire on tube condenser is positioned adjacent to a corresponding second substantially straight tube section of the of the second individual wire on tube condenser such that the adjacent corresponding substantially straight tube sections are spatially offset in reference to an airflow path of the condenser assembly, wherein the offset of at least two of the corresponding substantially straight tube sections is offset both vertically and horizontally in relation to the airflow path.

2. The wire on tube condenser assembly of claim 1, wherein each of the individual wire on tube condensers further comprise:

a serpentine tubular conduit having a serpentine tubular conduit inlet, a serpentine tubular conduit outlet, a plurality of U-shaped tube passes, each pass having two substantially straight tube sections joined by a U-shaped bend section, the two substantially straight tube sections oriented across a width of the serpentine tubular conduit, and the serpentine tubular conduit having a flow path progressing from the serpentine tubular conduit inlet, through the plurality of U-shaped tube passes, making alternate back and forth passes in a direction along the width of the serpentine tubular conduit, progressing along a length of the serpentine tubular conduit, and progressing to the serpentine tubular conduit outlet, and an extended heat transfer surface arranged connected to the two substantially straight tube sections across the length of the serpentine tubular conduit wherein the extended heat transfer surface comprises a plurality of wires wrapped around a length of the serpentine tubular conduit.

3. The wire on tube condenser assembly of claim 1, wherein the wire on tube condensers are configured to be operationally connected in at least one of the following: a parallel configuration, a series configuration, a configuration where the condensers are operationally connected in a parallel configuration and a series configuration, a bypass configuration where at least one condenser is operationally disconnected from the condenser assembly, a reverse configuration where the inlet and outlet of at least one condenser is operationally reversed, and a split configuration where at least one of the condensers is operationally connected to a separate heat exchange circuit.

4. The wire on tube condenser assembly of claim 1, wherein the wire on tube condensers are configured to be operationally connected in at least two of the following: a parallel configuration, a series configuration, a configuration where the condensers are operationally connected in a parallel configuration and a series configuration, a bypass configuration where at least one condenser is operationally disconnected from the condenser assembly, a reverse configuration where the inlet and outlet of at least one condenser is operationally reversed, and a split configuration where at least one of the condensers is operationally connected to a separate heat exchange circuit.

5. The wire on tube condenser assembly of claim 1, wherein each of the individual wire on tube condensers are profiled in such a way to present from a lateral side view and relative to at least one part of its length an inclination in a direction of which is inverted at least once relative to a plane which is substantially parallel to the general plane of the wire on tube condenser.

6. The wire on tube condenser assembly of claim 1, wherein the individual wire on tube condensers are separated by at least one spacer, wherein the at least one spacer directly connects to two condensers.

7. The wire on tube condenser assembly of claim 1, wherein a plurality of the corresponding substantially straight tube sections of the V-shaped configuration is offset both perpendicular to and along the airflow path.

8. An appliance comprising:

a machine compartment having a housing with at least one airflow path; an air passageway, operationally connected to the machine compartment and configured to provide an airflow path into the machine compartment, containing:

at least two sets of individual wire on tube condensers; where each of the at least two sets of individual wire on tube condensers has a condenser inlet and a condenser outlet; and an exhaust port for discharging heated air radiated from the at least two sets of individual wire on tube condensers;

where the at least two sets of individual wire on tube condensers are at least substantially locked and positioned in matingly engaged plural inverted V-shaped configurations forming a condenser assembly; and where the at least two sets of individual wire on tube condensers are operationally connected;

wherein each of the at least two sets of individual wire on tube condensers comprises a plurality of substantially straight tube sections arranged adjacent a corresponding plurality of substantially straight tube section of a neighboring individual wire on tube condenser, wherein each of the corresponding substantially straight tube sections of the neighboring individual wire on tube condensers is offset spatially both perpendicular to and along the airflow path.

9. The appliance of claim 8, wherein each of the at least two sets of individual wire on tube condensers further comprises:

a serpentine tubular conduit having a serpentine tubular conduit inlet, a serpentine tubular conduit outlet, a plurality of U-shaped tube passes, each pass having two substantially straight tube sections joined by a U-shaped bend section, the two substantially straight tube sections oriented across a width of the serpentine tubular conduit, and the serpentine tubular conduit having a flow path progressing from the serpentine tubular conduit inlet, through the plurality of U-shaped tube passes, making alternate back and forth passes in a direction along the width of the serpentine tubular conduit, progressing along a length of the serpentine tubular conduit, and progressing to the serpentine tubular conduit outlet, and an extended heat transfer surface arranged connected to the two substantially straight tube sections across the length of the serpentine tubular conduit wherein the extended heat transfer surface comprises a plurality of wires wrapped around a length of the serpentine tubular conduit.

10. The appliance of claim 8, wherein the wire on tube condensers are operationally connected in at least one of the following: parallel configuration, a series configuration, a configuration where the condensers are operationally connected in a parallel configuration and a series configuration, a bypass configuration where at least one condenser is operationally disconnected from the condenser assembly, a reverse configuration where the inlet and outlet of at least one condenser is operationally reversed, and a split configuration where at least one of the condensers is operationally connected to a separate heat exchange circuit.

11. The appliance of claim 8, wherein each of the at least two sets of individual wire on tube condensers are profiled in such a way to present from a lateral side view and relative to at least one part of its length an inclination in a direction of which is suddenly or progressively inverted at least once relative to a plane which is substantially parallel to the general plane of the wire on tube condenser.

12. The appliance of claim 11, wherein the wire on tube condensers are operationally connected in at least one of the following: parallel configuration, a series configuration, a configuration where the condensers are operationally connected in a parallel configuration and a series configuration, a bypass configuration where at least one condenser is operationally disconnected from the condenser assembly, a reverse configuration where the inlet and outlet of at least one condenser is operationally reversed, and a split configuration where at least one of the condensers is operationally connected to a separate heat exchange circuit.

13. The appliance of claim 8, wherein the at least two sets of individual wire on tube condensers are separated by at least one spacer, wherein the at least one spacer directly connects to two condensers.

14. The appliance of claim 8, wherein the at least two sets of individual wire on tube condensers are fastened to a surface of the air passageway with at least one fastener.

15. The appliance of claim 8, wherein the machine compartment further comprises a fan spaced within an interior volume of the machine compartment and configured to cause a flow of cooling air into the machine compartment from outside the machine compartment.

16. The appliance of claim 8, wherein the appliance is a refrigerator.

17. The appliance of claim 8, wherein the substantially straight tube sections of the individual wire on tube condensers are arranged perpendicular to the V-shaped configuration such that a plurality of the substantially straight tube sections of the neighboring individual wire on tube condenser are offset laterally in an outboard direction in relation to the V-shaped configuration.

18. A method for assembling a condenser assembly comprising the step of:

producing at least two sets of individual wire on tube condensers;

configuring the at least two wire on tube condensers to be operationally connected such that an air flow path is established through the condenser assembly; and engaging the at least two wire on tube condensers with one another such that the condensers are at least substantially locked and positioned in matingly engaged plural inverted V-shaped configurations thereby forming the condenser assembly;

wherein the at least two sets of individual wire on tube condenser assembly includes a plurality of stacked inverted V-shaped configurations; and wherein the two sets of individual wire on tube condensers further comprise a tubular conduit comprising a plurality of substantially straight tube sections interconnected by a plurality of U-shaped tube passes, wherein an adjacent pair of the substantially straight tube sections of each of the individual wire on tube condensers is offset both perpendicular to and along the air flow path forming the two wire on tube condensers of the condenser assembly.

19. The method of claim 18, further wherein the at least two separately and independently produced wire on tube condensers comprise a first condenser and a second condenser; and the method further comprising the steps of:

installing the first condenser within an appliance in an operational configuration, and installing the second condenser in an operational configuration and within the appliance such that the second condenser is substantially locked and positioned in the matingly engaged configuration with the first condenser thereby forming the condenser assembly within the appliance.

* * * * *